US007661610B2

(12) United States Patent
Yamada

(10) Patent No.: US 7,661,610 B2
(45) **Date of Patent: *Feb. 16, 2010**

(54) ELECTROSTATIC COATING DEVICE

(75) Inventor: Yukio Yamada, Fujieda (JP)

(73) Assignee: ABB K.K., Tokyo (JP)

( * ) Notice: Subject to any disclaimer, the term of this patent is extended or adjusted under 35 U.S.C. 154(b) by 93 days.

This patent is subject to a terminal disclaimer.

(21) Appl. No.: 11/916,499

(22) PCT Filed: May 31, 2006

(86) PCT No.: PCT/JP2006/311351

§ 371 (c)(1),
(2), (4) Date: Dec. 4, 2007

(87) PCT Pub. No.: WO2007/015335

PCT Pub. Date: Feb. 8, 2007

(65) Prior Publication Data

US 2009/0032625 A1 Feb. 5, 2009

(30) Foreign Application Priority Data

Aug. 1, 2005 (JP) ..... 2005-223153

(51) Int. Cl.
*B05B 5/025* (2006.01)
*B05B 5/04* (2006.01)
*B05B 3/10* (2006.01)
*B05C 5/00* (2006.01)

(52) U.S. Cl. ..... 239/706; 239/223; 239/224; 239/690; 239/700; 239/703; 118/627; 118/629

(58) Field of Classification Search ..... 239/3, 239/214, 223, 224, 690, 690.1, 691, 699, 239/700, 703, 705–708; 118/620, 621, 626–629
See application file for complete search history.

(56) References Cited

U.S. PATENT DOCUMENTS 5,100,057 A * 3/1992 Wacker et al. ..... 239/223
5,775,598 A * 7/1998 Takayama et al. ..... 239/703

FOREIGN PATENT DOCUMENTS

JP 59-7057 1/1984

(Continued)

OTHER PUBLICATIONS

U.S. Appl. No. 11/908,425, filed Sep. 12, 2007, Yamada, et al.

(Continued)

*Primary Examiner*—Darren W Gorman
(74) *Attorney, Agent, or Firm*—Oblon, Spivak, McClelland, Maier & Neustadt, L.L.P.

(57) ABSTRACT

An atomizer including an air motor and a rotary atomizing head, mounted in a front side of a housing member, while a high voltage generator applying a high voltage to paint through the air motor is mounted in a rear side of the housing member. A cover member is fitted on the housing member to cover an outer surface of the housing member. Opposite axial ends of the cover member are fitted on and attached to opposite axial ends of the housing member so as to leave an annular gap space between the cover member and the housing member. The annular gap space keeps almost entire radially confront areas of the cover member and the housing member, preventing high voltage electrostatic charges on the outer surfaces of the cover member from leaking through the housing member.

17 Claims, 20 Drawing Sheets

FOREIGN PATENT DOCUMENTS

| | | |
|---|---|---|
| JP | 4-74555 | 6/1992 |
| JP | 8-332418 | 12/1996 |
| JP | 10-109054 | 4/1998 |
| JP | 2001-113207 | 4/2001 |
| JP | 2005-125175 | 5/2005 |

OTHER PUBLICATIONS

U.S. Appl. No. 11/909,330, filed Sep. 21, 2007, Yamada.

* cited by examiner

ELECTROSTATIC COATING DEVICE

TECHNICAL FIELD

This invention relates to an electrostatic coating apparatus which is adapted to spray paint under application of a high voltage.

BACKGROUND ART

Generally, there has been known an electrostatic coating apparatus which is constructed of, for example, an atomizer consisting of an air motor and a rotary atomizing head, a housing member formed of an electrically insulating material and adapted to hold the air motor of the atomizer in position, a tubular cover member arranged to cover outer surfaces of the housing member, and a high voltage generator adapted to electrify atomized paint particles with a negative high voltage electrostatic charge as the paint particles are sprayed forward from the rotary atomizing head of the atomizer by using external electrode assembly (e.g., Japanese Patent Laid-Open No. 2001-113207).

In electrostatic coating apparatuses of this sort, an electrostatic field is formed by lines of electric force between an external electrode, to which a negative high voltage is applied, and a rotary atomizing head which is held at the earth potential, and between the external electrode and a work piece. Besides, a negative ionization zone is formed in the vicinity of a fore distal end of the external electrode assembly.

If, in this state, paint is sprayed by a rotary atomizing head which is put in high speed rotation, sprayed paint particles are electrified by application of a negative high voltage during travel through the ionization zone to become negatively charged paint particles. As a result, the charged paint particles are urged to fly toward and deposit on surfaces of a work piece which is connected to the earth.

In the case of the electrostatic coating apparatus of above-mentioned Japanese Patent Laid-Open No. 2001-113207, outer surfaces of the cover member are electrified to negative polarity by discharged negative ions. Therefore, repulsion takes place between the cover member and paint particles which are electrified to the same polarity, preventing the paint particles from depositing on outer surfaces of the cover member. In addition, the cover member which is formed of an electrically insulating material can prevent high voltage electrostatic charges on its outer surfaces from leaking to the side of the earth potential.

However, actually, as an electrostatic coating operation is continued, paint particles start to gradually deposit on outer surfaces of the cover member and remain there as a paint deposit. This paint deposit is problematic in that it gives rise to degradations in insulating performance of the outer surface of the cover member. Degradations in insulating performance of the cover member are reflected by paint deposition progressing at an abruptly increasing rate. Therefore, it is often the case with conventional electrostatic coating apparatuses that coating operations are interrupted frequently for removal of paint deposits.

Further, in the electrostatic coating apparatus according to the above-mentioned Japanese Patent Laid-Open No. 2001-113207, paint deposition is prevented by coating a water repellent paint on outer surfaces of a cover member. However, this electrostatic coating apparatus requires to coat water repellent paint periodically because outer surfaces of the machine need to be washed repeatedly after finishing coating operations and as a result the thickness of the water repellent coating becomes thinner and thinner. In addition, because of instability in quality, the use of the water repellent paint involves such problems as low yield of products and costly coating operations.

DISCLOSURE OF THE INVENTION

In view of the above-discussed problems with the prior art, it is an object of the present invention to build up high voltage electrostatic charges on outer surfaces of a cover member constantly in a stable state to prevent deposition of paint particles.

(1) According to the present invention, in order to achieve the above-stated objective, there is provided an electrostatic coating apparatus constructed of a paint atomizing means adapted to spray atomized paint particles toward a work piece, a housing member formed of an insulating material and holding the paint atomizing means in position, a tubular cover member formed in cylindrical shape by an insulating material and arranged to enshroud outer surfaces of the housing member, and a high voltage application means adapted to electrify sprayed paint particles from the paint atomizing means with a high voltage electrostatic charge, urging charged paint particles to fly toward and deposit on the work piece, characterized in that the electrostatic coating apparatus comprises a spacing provided between and around almost entire radially confronting areas of the housing and cover members.

Generally, as compared with air, the housing which is formed of an electrically insulating material is low in electrical resistivity. Therefore, a spacing is provided between almost entire confronting areas of the housing member and the cover member, reducing contacting areas of the cover member with the housing member which is lower than air in electrical resistivity, suppressing leaks of high voltage electrostatic charges on outer surfaces of the cover member through the housing member and thus maintaining the cover member in an electrified state to prevent deposition of charged paint particles.

(2) In a preferred form of the present invention, the cover member is formed of a fluorine-base synthetic resin film or a polyethylene resin film.

In this case, the cover member can be formed of a water repellent synthetic resin film, for example, a film of a fluorine-base resin like tetrafluoroethylene or a polyethylene resin film, preventing deposition of charged paint particles by the water repellent action of the cover material. Besides, by static electrification of the fluorine-base resin film or a polyethylene resin film, a repulsion force can be generated against charged paint particles. Further, because of low moisture absorption and high volume resistivity, a static charged state on a fluorine-base resin film or polyethylene resin film can be maintained in a stable state.

(3) In another preferred form of the invention, the cover member is formed of a laminated film material having a semi-conducting film sandwiched between two insulating films.

In this case, the semi-conducting film as a whole stabilizes substantially at the same potential because static charges can migrate within the semi-conducting film. The stability in potential of the semi-conducting film has an effect that an electrostatic charge can be built up more uniformly on the surface of an overlying insulating film.

Namely, when an electrostatic charge of negative polarity is built up on a surface on the front side of an insulating film, an electrostatic charge of positive polarity occurs on a surface on the back side of the insulating film due to a dielectric electrification phenomenon. At this time, positive charges on the back side of the insulating film which is in contact with the semi-conducting film are allowed to move within the semi-conducting film and spread over the entire cover member. As a result, negatively charged ions on the front side of the insulating film are also spread uniformly over the entire cover member under the influence of the Coulomb force against a positive charge.

Thus, negative electrostatic charge can be imparted to the surface of the insulating film more uniformly as compared with a cover without a semi-conducting film. Therefore, a repulsion force can be generated constantly between the insulating film and charged paint particles to reduce dirty spots which would otherwise appear as a result of localized paint deposits.

Accordingly, even in a situation where a build up of electrostatic charges hardly takes place in certain localities of the cover member under the influence of a gradient of potential in the cover member, the semi-conducting film comes to have the same potential, eliminating the influence of the gradient of potential in the cover member, which would affect a uniform build up of electrostatic charges on the insulating film on the side of the outer surface. As a consequence, when negative ions come flying toward the cover member, an electrostatic charge can be built up uniformly on the entire outer surfaces of the cover member in an assured manner to prevent deposition of charged paint particles, while preventing concentration of an electric field for prevention of deposition or accumulation of paint in certain localized areas.

(4) According to the invention, the housing member is formed in a columnar shape and adapted to hold the paint atomizing means in a front side portion, rear end of the columnar housing member being attached to and supported on a support arm, and the cover member is extended toward the support arm beyond the housing member to cover the support arm.

In this case, the cover member is extended toward the support arm of a robot device beyond a proximal end of the housing member, enshrouding a fore distal end portion of the support arm as well. Thus, even in case the support arm is connected to the earth ground, charged paint particles are prevented from depositing on the grounded support arm.

Further, since a distal end of the cover member can be located at a space from the support arm which is at the earth potential, there is no possibility of leakage of electrostatic charges from the cover member to the support arm even when surfaces of the cover member are smeared with paint to some extent. Therefore, the cover member is maintained in an electrified state in an assured manner to prevent growth of smeared spots.

(5) According to the present invention, the housing member is composed of a main housing body adapted to hold the paint atomizing means in a front side thereof, and a neck portion branched off the main housing body and attached to a support arm which supports the housing member, and the cover member is composed of a body cover enclosing the main housing body and a neck cover enclosing the neck portion of the housing member.

With the arrangements just described, the entire outer surfaces of the housing member can be wrapped in the body cover and neck cover of the cover member, and an electrostatic charge is built up on the body and neck covers to prevent deposition of charged paint particles.

(6) According to the present invention, the body cover and the neck cover are formed of a fluorine-base synthetic resin film or a polyethylene resin film.

Thus, the body cover can be formed of a water repellent, for example, such as a fluorine-base synthetic resin film like a tetrafluoroethylene film or a polyethylene resin film, preventing deposition of charged paint particles on the body cover by the water repellent properties of the cover material. Besides, charged paint particles kept away by repulsion force of electrostatic charges built on the cover member by static electrification of a fluorine-base synthetic resin film or of a polyethylene resin film. In addition, because of low moisture absorption and high volume resistivity, a fluorine-base synthetic resin film or a polyethylene resin film is less susceptible to leaks of electrostatic charges. Therefore, electrostatic charges can be built up and maintained on the body and neck covers in a stable state.

(7) According to the present invention, the body cover and the neck cover are formed of a laminated film having a semi-conducting film sandwiched between two insulating films.

In this instance, electrostatic charges can migrate in the semi-conducting film, so that the semi-conducting film as a whole comes to stabilize substantially the same potential. This stability of potential in the entire semi-conducting film has an effect of building up an electrostatic charge more uniformly on the surface of the overlying insulating film. As a consequence, negative charges can be imparted to the surface of the insulating film more uniformly as compared with a cover member without a semi-conducting film. It follows that a repulsion force can be generated between the insulating film and charged paint particles in a stabilized state to reduce smears by localized paint deposits.

Therefore, even when a build up of electric charges hardly takes place on some part of the body cover under the influence of a gradient of potential, the whole semi-conducting film can be stabilized substantially at the same potential to eliminate the influence of the gradient of potential in the cover member, which would affect a uniform build up of electrostatic charges on the insulating film on the side of the outer surface. As a consequence, when negative ions come flying toward the body cover, an electrostatic charge can be built up uniformly on the entire outer surfaces of the insulating film of the body cover. Similarly, an electrostatic charge can be built up uniformly on the entire surfaces of the outer insulating film of the neck cover.

Thus, an electrostatic charge can be built up in an assured manner on the whole body cover and on the whole neck cover as well to prevent deposition of charged paint particles, while preventing concentration of an electric field for prevention of deposition or accumulation of paint in certain localized areas.

(8) According to the present invention, the body cover is formed of a fluorine-base synthetic resin film or a polyethylene resin film, and the neck cover is formed of a laminated film having a semi-conducting film sandwiched between two insulating films.

In this instance, the main housing body of the housing member is located at a distance from the support arm of a robot device which is at the earth potential, so that main housing body has substantially the same potential as a whole, involving less variations in potential if any. Therefore, when negative ions come flying toward the body cover, an electrostatic charge is built up uniformly on the entire body cover which enshrouds the main housing body, suppressing paint deposition against the body cover in an easy manner.

In contrast, the neck portion of the housing member which accommodates the high voltage generator is, for example, connected to the support arm which is at the earth potential, so that a large gradient of potential occurs between the top and bottom ends of the neck portion. Under the influence of this gradient of potential, a build up of electrostatic charge may not take place uniformly on some part of the neck cover.

However, according to the invention, the neck cover is formed of a laminated film having a semi-conducting film sandwiched between two insulating films. In this case, electric charges can migrate within the semi-conducting film, stabilizing the potential substantially to the same value in the entire semi-conducting film. This stability in potential of the semi-conducting film has an effect of building up an electrostatic charge uniformly on the surface of the overlying outer insulating film.

Namely, when a negative charge is built up on the front side of the outer insulating film, a positive charge occurs on the back side of the insulating film as a result of a dielectric electrification phenomenon. At this time, the positive charge on the back side of the insulating film is allowed to migrate through the underlying semi-conducting film and spread over the entire areas of the neck cover. Concurrently, negatively charged ions on the front surface of the insulating film are spread uniformly over the entire areas of the neck cover under the influence of the Coulomb force against a positive charge.

As a result, a negative charge can be built up on the surface of the insulating film more uniformly as compared with a cover without a semi-conducting film layer. Therefore, a repulsion force can be generated between the insulating film and charged paint particles in a stabilized state to reduce smears by locally deposited paint.

Therefore, even when a build up of electrostatic charges hardly takes place on some part of the neck cover due to a gradient of potential in the neck portion, for example, the entire semi-conducting film can be stabilized substantially at the same potential to eliminate the influence of the gradient of potential in the neck portion, which would affect a uniform build up of electrostatic charges on the outer insulating film. As a consequence, when negative ions come flying toward the neck cover, an electrostatic charge can be built up uniformly on the entire surfaces of the outer insulating film of the neck cover. Thus, an electrostatic charge can be built up in an assured manner on the whole neck cover to prevent deposition of charged paint particles, while preventing concentration of an electric field for prevention of deposition or accumulation of paint in certain localized areas.

(9) According to the present invention, the neck cover is extended beyond the neck portion of the housing member as far as a position of the support arm to cover the support arm.

Thus, paint deposition on the support arm is prevented, for example, even in a case where an arm of a robot device is connected to earth ground.

Besides, since a distal end of the neck cover is spaced from the support arm which is at the earth potential, there is no possibility of leakage of electrostatic charges to the support arm through the distal end of the neck cover even if the surface of the neck cover is smeared with paint to some extent. That is to say, a build up of electrostatic charges on the neck cover is maintained in an assured manner to reduce paint smears.

(10) According to the present invention, the electrostatic coating apparatus further comprises a high voltage discharge electrode assembly located on the outer peripheral side of the cover member and adapted to discharge a high voltage of the same polarity as charged paint particles.

In this case, ions of the same polarity as charged paint particles can be discharged from a high voltage discharge electrode assembly to electrify the cover member with electrostatic charges of the same polarity. In addition, a high voltage electrostatic field can be formed on the outer peripheral side of the cover member by the high voltage discharge electrode assembly. Thus, by the electrostatic field of the high voltage discharge electrode assembly, charged paint particles are kept off the cover member, and at the same time deposition of charged paint particles is prevented by a build up of high voltage electrostatic charges on the cover member.

(11) According to the present invention, the high voltage discharge electrode assembly is composed of support arms extended radially outward from the side of the housing member toward the outer peripheral side of the cover member, a ring member supported on outer distal ends of the support arms and located around the paint atomizing means in such a way as to circumvent the cover member, an acicular or blade-like electrode member projected from the ring member in a direction away from a work piece.

With the arrangements just described, charged paint particles are kept off the cover member by a high voltage electrostatic field which is formed around the cover member by the circumventing ring member. On the other hand, by discharges of high voltage from the electrode member which is extended in a direction away from a work piece, the cover member can be electrified with high voltage electrostatic charges up to remote areas from the work piece, preventing deposition of charged paint particles on broad areas of the cover member.

(12) According to the present invention, the paint atomizing means is constituted by an air motor accommodated in the housing member, and a rotary atomizing head rotationally coupled with the air motor on the front side of the latter and provided with paint releasing edges at a fore distal end thereof.

Thus, paint can be sprayed from the rotary atomizing head which is put in high speed rotation by the air motor.

(13) According to the present invention, the high voltage application means is adapted to apply a high voltage to the rotary atomizing head, directly applying a high voltage to paint being supplied to the rotary atomizing head.

Thus, prior to atomization, a high voltage can be directly applied to paint which has been supplied to the rotary atomizing head. Besides, since a high voltage is applied not only to the rotary atomizing head but also to the air motor, high voltage electrostatic charge can be built up on outer surfaces of the cover member in an assured manner by the air motor to prevent deposition of paint particles.

(14) According to the present invention, the high voltage application means is adapted to apply a high voltage to an external electrode assembly located radially outward of the cover member for indirectly imparting a high voltage electrostatic charge to sprayed paint particles from the rotary atomizing head.

Thus, an ionization zone is formed around the rotary atomizing head by the external electrode assembly, indirectly imparting an electrostatic charge to paint particles which are sprayed by the rotary atomizing head. Besides, by the external electrode assembly to which a high voltage is applied, a high electrostatic charge is built up on outer surfaces of the cover member in a stable state to prevent deposition of paint particles.

BEST MODE FOR CARRYING OUT THE INVENTION

Hereafter, with reference to the accompanying drawings, the present invention is described more particularly by way of its preferred embodiments which are applied to a rotary atomizing head type coating apparatus typical of electrostatic coating machines.

Figure 1:
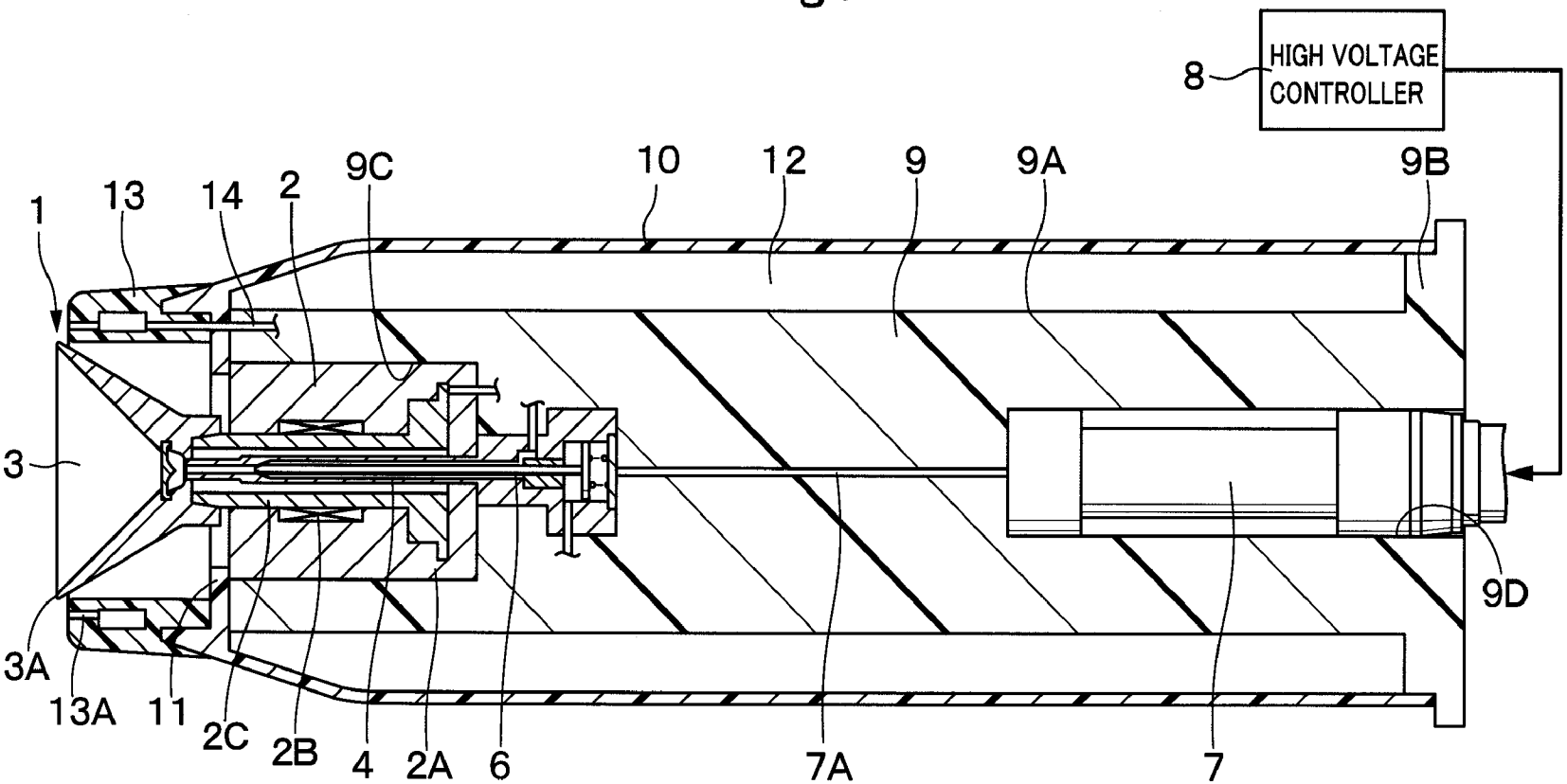
FIG. 1 is a longitudinal sectional view of a rotary atomizing head type coating apparatus according to a first embodiment of the invention.
Figure 2:
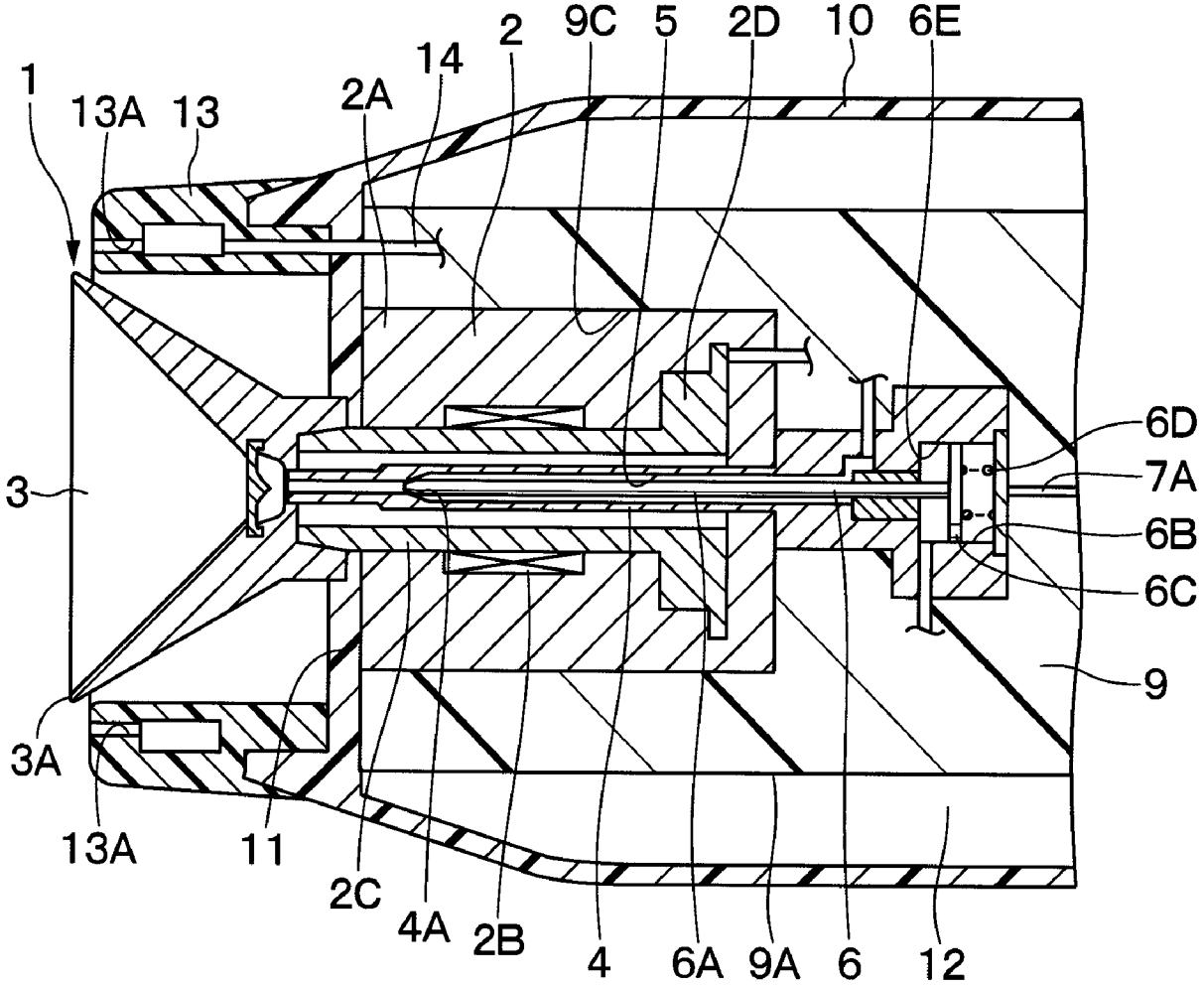
FIG. 2 is an enlarged sectional view of an atomizer of FIG. 1 and surrounding parts.

First, referring to FIGS. 1 and 2, there is shown a first embodiment of the present invention. In these figures, indicated at 1 is an atomizer serving as a paint spray means for spraying atomized paint particles toward a work piece (not shown) which is held at the earth potential. This atomizer 1 is mainly composed of an air motor 2 and a rotary atomizing head 3, which will be described hereinafter.

Denoted at 2 is an air motor which is formed of a conducting metallic material. This air motor 2 is constituted by a motor housing 2A, a hollow rotational shaft 2C which is rotatably supported in the motor housing 2A through a static air bearing 2B, and an air turbine 2D which is fixedly mounted on a base end portion of the rotational shaft 2C. As drive air is supplied to the air turbine 2D of the air motor 2, the rotational shaft 2C and rotary atomizing head 3 are put in high speed rotation, for example, at a speed of 3,000 r.p.m. to 100,000 r.p.m.

Indicated at 3 is a rotary atomizing head which is mounted on a fore end portion of the rotational shaft 2C of the air motor 2. This rotary atomizing head 3 is formed, for example, of a metallic material or conducting synthetic resin material. Through a feed tube 4 which will be described later on, paint is supplied to the rotary atomizing head 3 which is put in high speed rotation by the air motor 2. The supplied paint is atomized and sprayed forward from paint releasing edges 3A of the fore distal end of the rotary atomizing head 3 under the influence of centrifugal force. Further, through the air motor 2, the rotary atomizing head 3 is connected to a high voltage generator 7, which will be described hereinafter. Therefore, at the time of an electrostatic coating operation, a high voltage can be applied to the rotary atomizing head 3 to directly apply a high voltage electrostatic charge to paint which is flowing over the surfaces of the rotary atomizing head 3.

Designated at 4 is a feed tube which is passed internally of the hollow rotational shaft 2C. Fore end of this feed tube 4 is projected out of the hollow rotational shaft 2C and extended into the rotary atomizing head 3. Further, a paint passage 5 which is provided internally of the feed tube 4 is connected to a paint supply source and a cleaning thinner supply source through a color changing valve (all not shown). A valve seat 4A, to be seated on and off by a valve body 6A which will be described hereinafter, is provided at a longitudinally intermediate portion of the feed tube 4. Thus, at the time of a coating operation, the feed tube 4 is used to supply paint to the rotary atomizing head 3 from a paint supply source through the paint passage 5, and, at the time of a cleaning operation or at the time of color change, it is used to supply a cleaning fluid (thinner, air and so forth) from a cleaning thinner source.

The feed tube 4 is not limited to the particular form shown in the present embodiment. For example, it may be formed of a double tube construction having a paint passage in an inner tube and a cleaning thinner passage in an outer tube which is provided coaxially on the outer side of the inner tube. Further, instead of being passed internally of the feed tube 4 as in the present embodiment, the paint passage 5 may be arranged differently depending upon the type of the atomizer 1.

Indicated at 6 is, for example, a normally closed paint supply valve which is located in the course of the paint passage 5. This paint supply valve 6 is constituted by a valve body 6A which is extended axially and internally of the paint passage 5 to have its fore end seated on and off the valve seat 4A, a piston 6C connected to the base end of the valve body 6A and slidably fitted in a cylinder 6B, a valve spring 6D biasing the valve body 6A in the cylinder 6B in a closing direction, and a pressure receiving chamber 6E provided within the cylinder 6B opposingly to the valve spring 6D. As valve drive air (a pilot air pressure) is introduced into the pressure receiving chamber 6E of the paint supply valve 6, the valve body 6A is opened against the biasing action of the valve spring 6D to permit a flow of paint through the paint passage 5.

Indicated at 7 is a high voltage generator which is connected to the air motor 2 to serve as a high voltage application means. This high voltage generator 7 is constituted by a multi-stage rectification circuit (so-called Cockcroft circuit) composed of a plural number of capacitors and diodes (both not shown). Further, the high voltage generator 7 generates a high voltage, for example, a high voltage of from −30 kV to −150 kV by elevating a DC source voltage which is supplied from a high voltage controller 8. In this instance, the voltage to be generated by the high voltage generator 7 is determined dependent on the source voltage which is supplied from the high voltage controller 8, that is to say, the output voltage (the output high voltage) of the high voltage generator 7 is controlled from the side of the high voltage controller 8. By way of a high voltage cable 7A, the high voltage generator 7 is connected to the air motor 2 and the rotary atomizing head 3, so that paint on the rotary atomizing head 3 is directly imparted with a high voltage electrostatic charge.

Denoted at 9 is a housing member on which the air motor 2 and the high voltage generator 7 are mounted. This housing member 9 is formed substantially in a cylindrical shape by the use of an electrically insulating synthetic resin material such as POM (polyoxymethylene), PET (polyethylene terephthalate), PEN (polyethylene naphthalate), PP (polypropylene), HP-PE (high pressure polyethylene), HP-PVC (high pressure polyvinyl chloride), PEI (polyether imide), PES (polyether sulfon), or polymethyl pentene.

The housing member 9 is provided with a cylindrical outer surface 9A around its outer periphery, and formed with a flanged large diameter portion at its rear end 9B. A motor receptacle hole 9C is formed in a front side portion of the housing member 9 to accommodate the air motor 2, while a generator receptacle hole 9D is formed in a rear side portion to accommodate the high voltage generator 7.

Indicated at 10 is a tubular cover member which is provided around the outer surface 9A of the housing member 9 in a radially spaced relation with the latter. This cover member 10 is formed of a synthetic resin material with highly insulating and non-water absorbing properties, for example, a synthetic resin material such as PTFE (polytetrafluoroethylene), POM (polyoxymethylene) or PET (polyethylene terephthalate) with surfaces treated with a water repellent agent. In order to maintain a mechanical strength, the tubular cover member 10 is formed in a tubular shape and a predetermined thickness, for example, in a thickness of approximately 0.1 mm to 5 mm. Further, provided at the fore end of the cover member 10 is an annular front closing member 11 which is projected radially inward from the inner periphery of the cover member 10 in such a way as to close the front end of the housing member 9.

In this instance, rear end of the cover member 10 is fitted on the large diameter rear end 9B of the housing member 9 while its fore end is attached to the front closing member 11. However, except the rear and fore ends, almost entire part of the cover member 10 (axially intermediate portion of the cover member 10) which is disposed face to face with the housing member 9 is radially spaced from the housing member 9. As a consequence, an annular gap space 12, which is an annular shape in cross section, is formed between the housing member 9 and the cover member 10 in such a way as to circumvent almost entirely the outer peripheries of the air motor 2 and the high voltage generator 7. More specifically, the annular gap space 12 is formed, for example, in a width greater than 5 mm between the cover member 10 and the housing member 9 to prevent leak current from the cover member 10 to the housing member 9.

Indicated at 13 is a shaping air ring which spurts out shaping air. This shaping air ring 13 is provided at the fore end (front end) of the cover member 10 through the front closing member 11 in such a way as to enclose the outer periphery of the rotary atomizing head 3. The shaping air ring 13 is formed in a tubular shape by the use of a material similar to the cover member 10, for example, by the use of PTFE, POM or PET with surfaces treated with a water repelling agent. Further, a plural number of air outlet holes 13A bored in the shaping air ring 13 in communication with a shaping air passage 14 which is provided internally of the housing member 9. Shaping air which is supplied to the shaping air outlet holes 13A through the shaping air passage 14 is spurted out toward paint which is sprayed forward by the rotary atomizing head 3, shaping a spray of paint particles into a desirable spray pattern.

With the arrangements as described above, the rotary atomizing head type coating apparatus of the first embodiment gives the following performances in an electrostatic operation.

Through the feed tube 4, paint is supplied to the rotary atomizing head 3 which is put in high speed rotation by the air motor 2. The supplied paint is divided into finely atomized particles and sprayed forward under the influence of centrifugal force resulting from the high speed rotation of the rotary atomizing head 3. On the other hand, shaping air is supplied to and spurted out from the shaping air ring 13 to control the spray pattern of paint particles.

At the same time, a high voltage is applied to the rotary atomizing head 3 from the high voltage generator 7 through the air motor 2. Therefore, the paint which has been supplied to the rotary atomizing head 3 is directly imparted with a high voltage electrostatic charge by the rotary atomizing head 3, and charged paint particles are urged to fly toward and deposit on a work piece, traveling along an electrostatic field which is formed between the rotary atomizing head 3 and the work piece.

Generally, air is assumed to be infinite in volume resistivity, in contrast to the insulating synthetic resin material used for the housing member 9 (a dielectric material), which is approximately in the range of $10^{12}\Omega$ to $10^{16}\Omega$ in volume resistivity. Thus, as compared with air, the housing member 9 is low in electrical resistivity.

Taking this into consideration, in the first embodiment, an annular gap space 12 is provided between almost the entire confronting areas of the housing member 9 and the cover member 10. Thus, except minimum contacting areas, the cover member 10 is kept out of contact with the housing member 9 which is lower than air in electrical resistivity. As a result, high voltage electrostatic charges on the outer surfaces of the cover member 10 are prevented from leakage through the housing member 9, maintaining high voltage electrostatic charges on the cover member 10 to prevent deposition of charged paint particles.

Further, in the first embodiment, the atomizer 1 is constituted by the air motor 2 and the rotary atomizing head 3. In this case, from the rotary atomizing head 3, charged paint particles are released on the outer peripheral side of the housing member 9. These charged paint particles tend to float in the air around the housing member 9. At the time of carrying out a coating operation with in a closed space like a coating operation inside of a vehicle body, there is a tendency of floating charged paint particles approaching and depositing on the housing member 9. However, in the case of the first embodiment of the invention, the cover member 10 is maintained in an electrostatically charged state by the provision of the annular gap space 12 to generate a Coulomb repulsion force between the cover member 10 and floating charged paint particles, thereby preventing deposition of paint particles on the cover member 10 which is located to enclose the atomizer 1.

Further, the high voltage generator 7 is adapted to apply a high voltage to the air motor 2. Therefore, by the air motor 2, outer surfaces of the cover member 10 are electrified with a high voltage electrostatic charge in a stable state to prevent deposition of paint particles.

Figure 3:
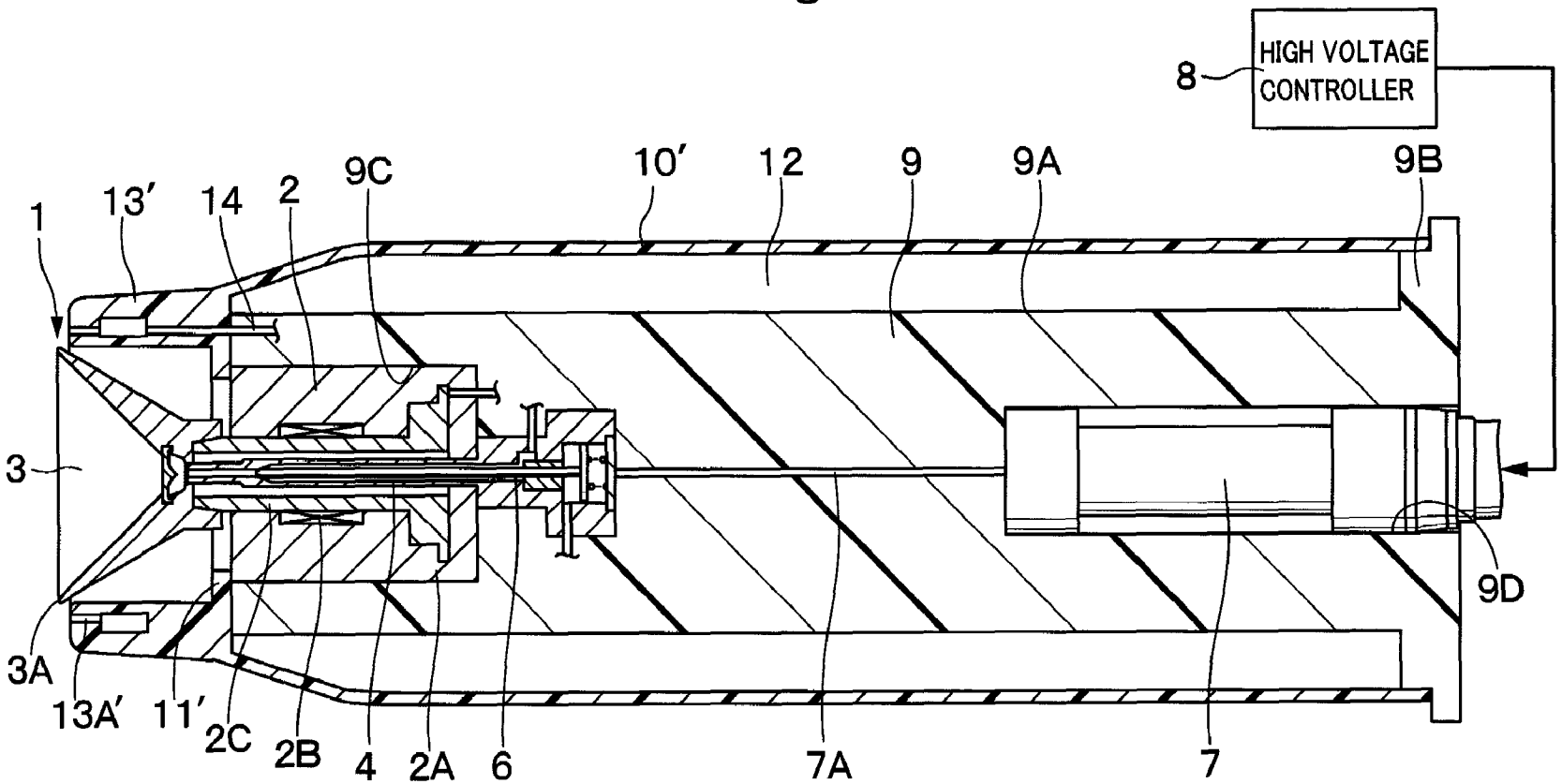
FIG. 3 is a longitudinal sectional view of a rotary atomizing head type coating apparatus according to a first modification.
Figure 4:
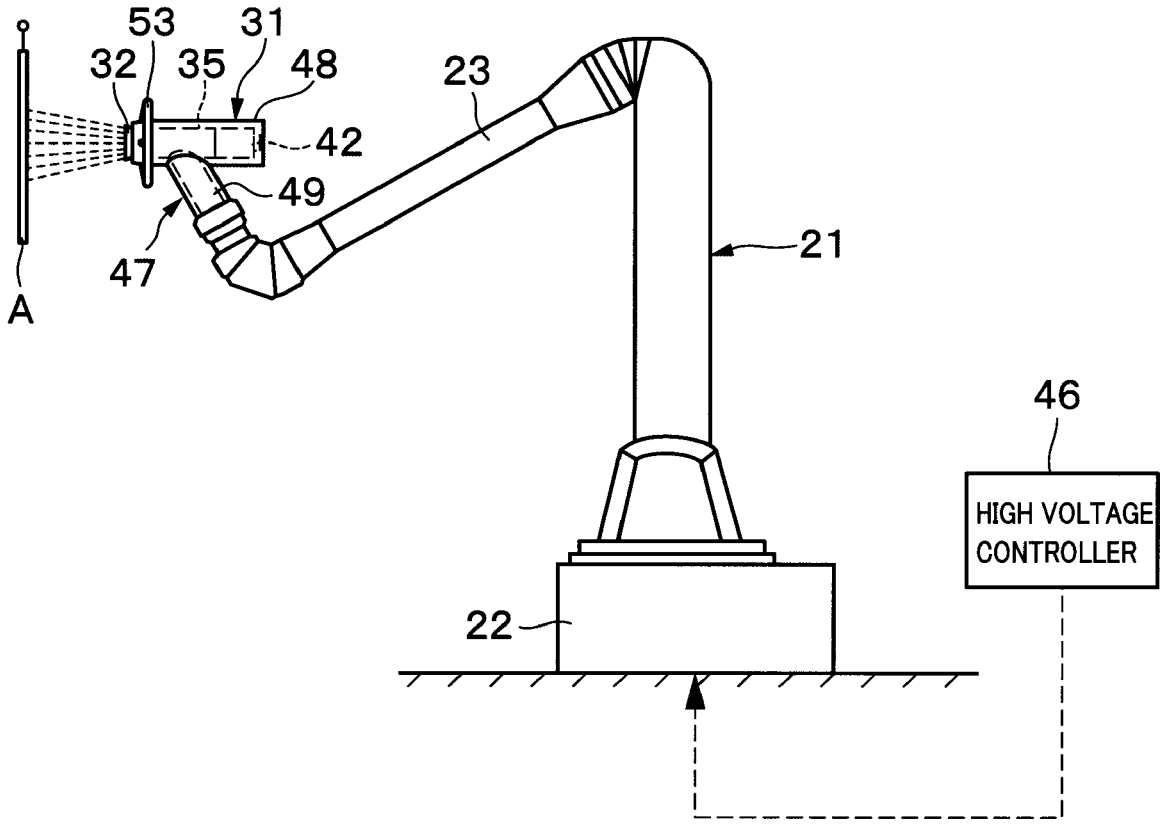
FIG. 4 is a front elevation of a rotary atomizing head type coating apparatus according to a second embodiment of the invention.
Figure 5:
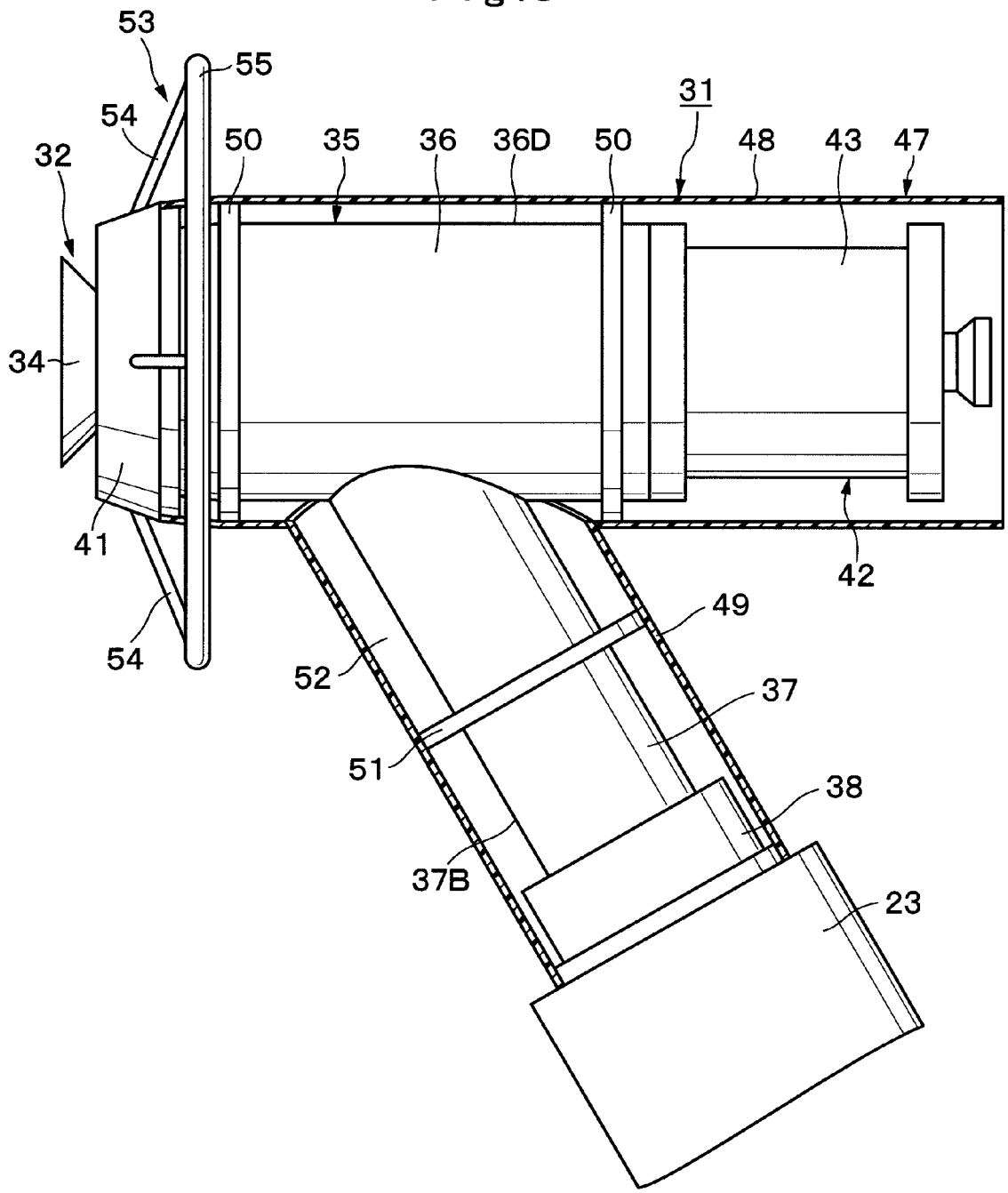
FIG. 5 is an enlarged front view of the paint coating apparatus of FIG. 4 with a cover member cut away for the convenience of illustration.
Figure 6:
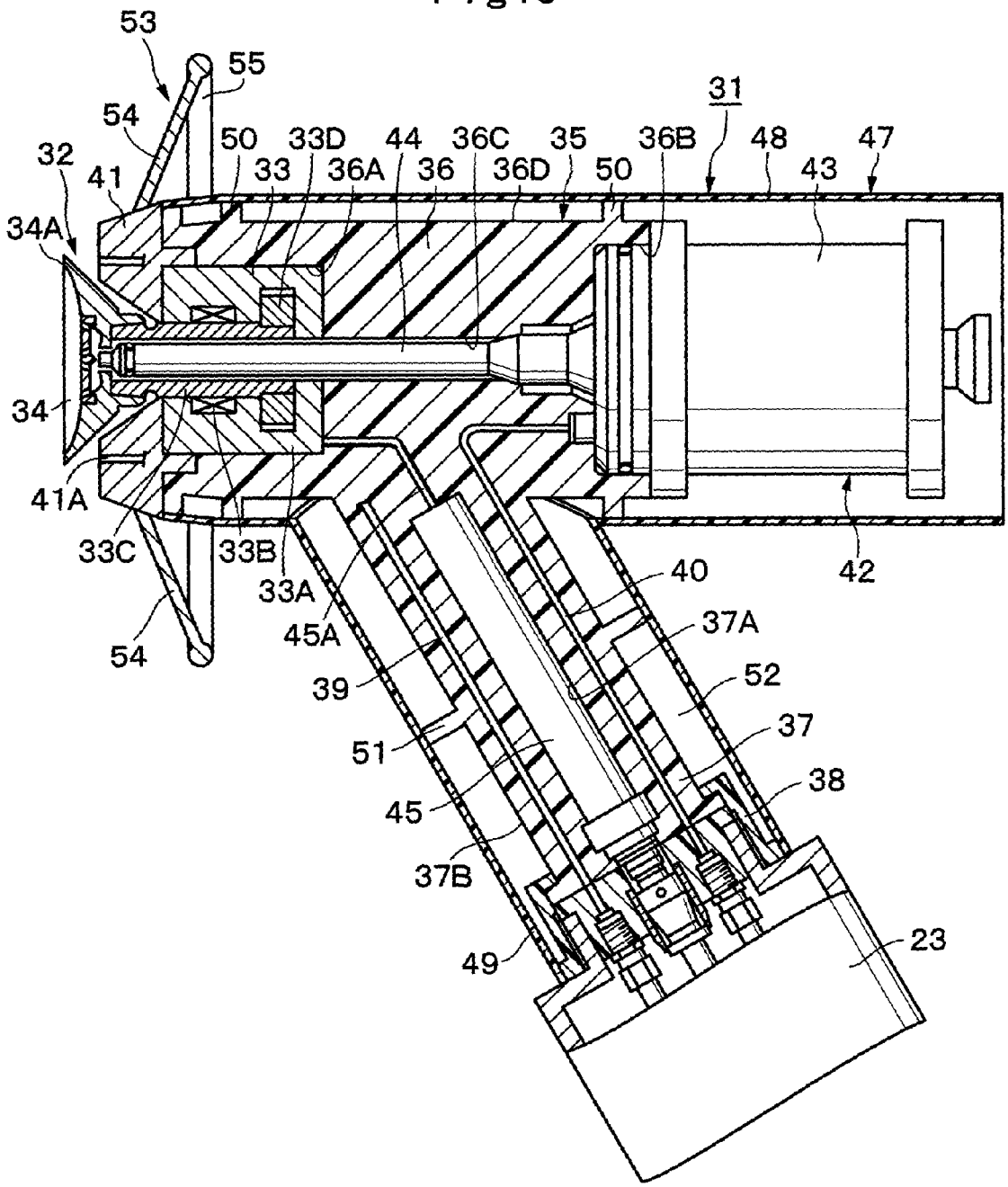
FIG. 6 is a longitudinal sectional view of the paint coating apparatus of FIG. 4.
Figure 7:
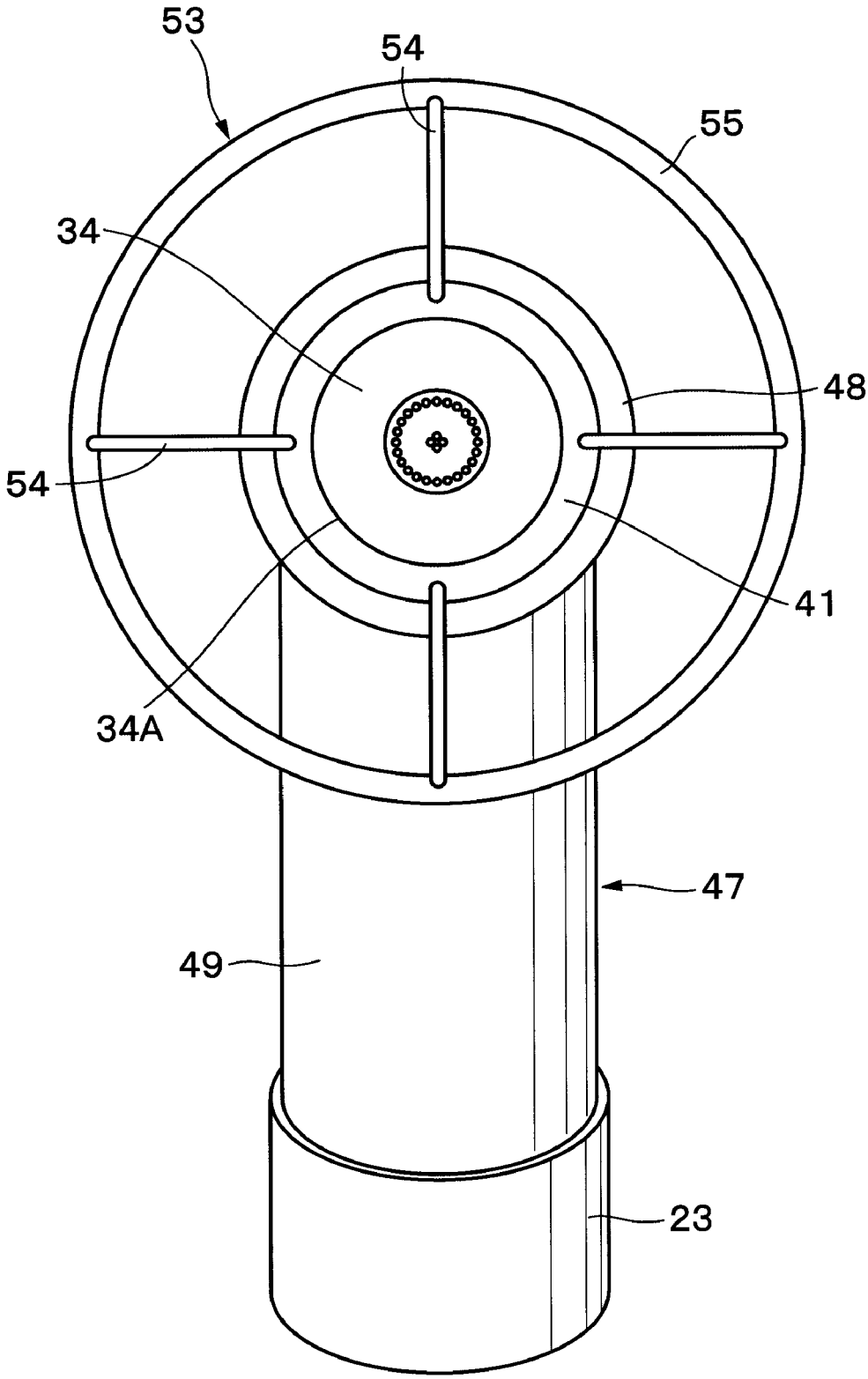
FIG. 7 is a left-hand side view of the paint coating apparatus of the second embodiment shown in FIG. 5.

In the first embodiment, the cover member 10 is provided as a separate member from the shaping air ring 13. However, the present invention is not limited to this particular embodiment. For example, as shown in a first modification of FIG. 3, a cover member 10' and a shaping air ring 13' may be integrated into one and single structure.

Further, in the first embodiment, the shaping air ring 13 is formed of an electrically insulating synthetic resin material. However, the present invention is not limited to this particular embodiment. For example, the shaping air ring 13 may be formed of a conducting metallic material. In this case, a high voltage of the same polarity as charged paint particles is applied to the metallic shaping air ring through the air motor, so that the shaping air ring can act as a repulsive electrode to prevent deposition of charged paint particles against the shaping air ring.

Now, turning to FIGS. 4 through 7, there is shown a rotary atomizing head type coating apparatus according to a second embodiment of the invention. This second embodiment has features in that the housing member is constituted by a main housing body extended in forward and rearward directions and adapted to hold a paint atomizing means at a front end thereof and a neck portion branched off the main housing body, and the cover member is constituted by a body cover wrapped around the main housing body and a neck cover wrapped around the neck portion of the housing member.

In the drawings, indicated at 21 is a robot device for an automatic coating operation. This robot device 21 carries out a coating operation automatically by the use of a coater unit 31 which will be described hereinafter. The robot device 21 is largely constituted by a base 22, and a robot arm (an arm) 23 which is rotatably and swingably supported on the base 22 and provided with a plural number of articular joints. The robot device 21 is capable of moving a coater unit 31 relative to a work piece A, and connected to the earth ground.

Indicated at 31 is a cartridge type coater unit mounted on the robot device 21, which is largely constituted by an atomizer 32, a housing member 35 and a paint cartridge 42, which will be described hereinafter.

Denoted at 32 is an atomizer serving as a paint atomizing means for spraying atomized paint particles toward a work piece A which is at the earth potential. The atomizer 32 is constituted by an air motor 33 and a rotary atomizing head 34.

Indicated at 33 is an air motor which is constructed of an electrically conducting metallic material. This air motor 33 is constituted by a motor housing 33A, a hollow rotational shaft 33C which is rotatably supported in the motor housing 33A through a static air bearing 33B, and an air turbine 33D which is fixedly mounted on a base end portion of the rotational shaft 33C. Through an air passage 39 which will be described later on, drive air is supplied to the air turbine 33D of the air motor 33 to rotate the rotational shaft 33C and the rotary atomizing head 34 at a high speed, for example, at a speed of 3,000 r.p.m. to 100,000 r.p.m.

Designated at 34 is a rotary atomizing head which is mounted on a fore end portion of the rotational shaft 33C of the air motor 33. This rotary atomizing head 34 is constructed of, for example, a metallic material or a conducting synthetic resin material. Through a feed tube 44 which will be described hereinafter, paint is supplied to the rotary atomizing head 34 which is put in high speed rotation by the air motor 33, whereupon the supplied paint is atomized and sprayed forward from paint releasing edges 34A at the fore distal end of the rotary atomizing head 34 under the influence of centrifugal force. Through the air motor 33, the rotary atomizing head 34 is connected to a high voltage generator 45 which will be described later on. Thus, a high voltage can be applied to the rotary atomizing head 34 as a whole for imparting a high voltage electrostatic charge directly to paint flowing on surfaces of the rotary atomizing head 34.

Indicated at 35 is a housing member which is adapted to hold the air motor 33 therein. Similarly to the housing member 9 in the foregoing first embodiment, this housing member 35 is formed of an electrically insulating synthetic resin material such as POM (polyoxymethylene), PET (polyethylene terephthalate), PEN (polyethylene naphthalate), PP (polypropylene), HP-PE (high pressure polyethylene), HP-PVC (high pressure polyvinyl chloride), PEI (polyether imide), PES (polyether sulfon), or polymethyl pentene.

Further, the housing member 35 is composed of a cylindrical main housing body 36 which is extended in an axial direction (i.e., in forward and rearward directions), and a neck portion 37 which is branched out in an obliquely downward direction at an axially intermediate position on the outer periphery of the main housing body 36.

A motor receptacle hole 36A is formed in a front side portion of the main housing body 36 to accommodate the air motor 33 therein, while a container receptacle hole 36B is formed in a rear end portion of the main housing body 36 to hold a container 43 of a paint cartridge 42 which will be described hereinafter. Further, a feed tube passage hole 36C is formed internally of the main housing body 36, axially through centers of the motor receptacle hole 36A and the container receptacle hole 36B.

On the other hand, a generator receptacle hole 37A is formed in the neck portion 37 to accommodate a high voltage generator 45 which will be described hereinafter. A lower proximal end of the neck portion 37 is attached to the distal end of the robot arm 23 of the robot device 21 by means of a tubular connector member 38 which is formed of an insulating synthetic resin material. Further, an air passage 39 is formed internally of the housing member 35 to supply drive air to the air motor 33, along with an extending liquid passage 40 which supplies an extending liquid to the paint cartridge 42, which will be described later, for controlling the quantity of paint discharge.

Denoted at 41 is a shaping air ring which is provided at the fore end of the main housing body 36 of the housing member 35 in such a way as to circumvent the rotary atomizing head 34. This shaping air ring 41 is formed, for example, of an electrically conducting metallic material, and electrically connected to the air motor 33. A plurality of air outlet holes 41A are bored in the shaping air ring 41 to spurt out shaping air toward paint which is sprayed from the rotary atomizing head 34.

Indicated at 42 is a paint cartridge which supplies paint to the rotary atomizing head 34. This paint cartridge 42 is largely constituted by an axially extending tubular (cylindrical) container 43, a feed tube 44 axially extending from the container 43, and a piston defining a paint chamber and an extending liquid chamber (both not shown) within the container 43.

The paint cartridge 42 is set in the container receptacle hole 36B of the housing member 35, with the feed tube 44 placed in the feed tube passage hole 36C. At the time of a coating operation, an extending liquid is supplied to the extending liquid chamber through the extending liquid passage 40 of the housing member 35 thereby putting the piston in a sliding displacement to deliver paint in the container 43 to the rotary atomizing head 34 through the feed tube 44. On the other hand, at the time of refilling paint, the paint cartridge 42 is dismantled from the container receptacle hole 36B and attached to a paint replenisher (not shown), and then paint is refilled into the paint chamber of the container 43 through the feed tube 44.

Indicated at 45 is a high voltage generator which is accommodated in the neck portion 37 of the housing member 35 to serve as a high voltage application means. Input side of the high voltage generator 45 is connected to an external high voltage controller 46 through the robot device 21, while its output side is connected to the air motor 33. The high voltage generator 45 is constituted, for example, by a multi-stage rectification circuit (so-called Cockcroft circuit) composed of a plurality of capacitors and diodes (both not shown).

Further, by elevating a DC source voltage which is supplied from the high voltage controller 46, the high voltage generator 45 generates a high voltage, for example, in the range of −30 kV to −150 kV. At this time, the output voltage of the high voltage generator 45 is determined depending upon the level of the source voltage which is supplied from the high voltage controller 46, that is to say, the output voltage (a high voltage) of the high voltage generator 45 is controlled by the high voltage controller 46. By way of a high voltage cable 45A, the high voltage generator 45 is connected to the air motor 33 and the rotary atomizing head 34 to impart a high voltage electrostatic charge directly to paint.

Indicated at 47 is a cover member which is arranged to enshroud outer surfaces of the housing member 35. This cover member 47 is formed of an electrically insulating fluorine-base synthetic resin which is high in insulating performance and non-hydrophilic, for example, a fluorine-base synthetic resin such as PTFE (polytetrafluoroethylene) and ETFE (a copolymer of ethylene and tetrafluoroethylene). Further, the cover member 47 is composed of a body cover 48 enclosing outer surfaces 36D of the main housing body 36 and a neck cover 49 enclosing outer surfaces 37B of the neck portion 37. Each one of the covers 48 and 49 is formed by rolling a 0.1 mm-5 mm thick synthetic resin film into a tubular shape.

In this instance, the body cover 48 around the circumference of the main housing body 36 is extended further rearward to enclose not only the outer surface 36D of the main housing body 36 but also the outer surface of the container 43 of the paint cartridge 42. Further, the body cover 48 is fitted and attached on annular flanges 50 which are provided at the fore and rear ends of the main housing body 36. On the other hand, the neck cover 49 is fitted and attached on an annular flange 51 which is provided in a longitudinally intermediate portion of the neck portion 37, and the connector member 38 which is provided at the lower proximal end of the neck portion 37.

Except minimal areas which are in contact with the flanges 50, almost the entire areas of the body cover 48 which are confronted face to face with the outer surface 36D of the main housing body 36 are spaced from and kept out of contact with the main housing body 36. Similarly, except minimal areas which are in contact with the flange 51 and the connector member 38, almost the entire areas of the neck cover 49 which are confronted face to face with the outer surface 37B of the neck portion 37 are spaced from and kept out of contact with the neck portion 37.

As a consequence, an annular gap space 52, which is in an annular shape in cross-section, is formed between the main housing body 36 and the body cover 48, and between the neck portion 37 and the neck cover 49. That is to say, the annular gap space 52 is formed between almost entire confronting areas of the cover member 47 and the housing member 35. On the outer peripheral side, the air motor 33 and high voltage generator 45 are almost entirely circumvented by the annular gap space 52. The annular gap space 52 is formed in a width greater than 5 mm between the cover member 47 and the housing member 35 in order to prevent leak current from the cover member 47 to the housing member 35.

Denoted at 53 is a high voltage discharge electrode assembly which is located on the outer peripheral side of the body cover 48. This high voltage discharge electrode assembly 53 is formed of a conducting material, and constituted by support arms 54 and a ring member 55, which will be described hereinafter.

Denoted at 54 are radial support arms which are provided around the shaping air ring 41. These support arms 54 are extended radially outward from the side of the housing member 35 toward a point on the outer peripheral side of the body cover 48. Four support arms 54, for example, are provided at uniform angular intervals around the shaping air ring 41 to support a ring member 55 thereon.

Indicated at 55 is a ring member which is supported on distal ends of the support arms 54. This ring member 55 is formed in the shape of a ring by the use of a conducting material like a metal, for example. Further, the ring member 55 is located around the air motor 33 in such a way as to circumvent a front portion of the body cover 48. In addition, the ring member 55 is formed in a circular shape which is larger than the outside diameter of the body cover 48, and located in substantially concentric relation with the rotational shaft 33C of the air motor 33. As a consequence, the ring member 55 is located substantially at the same distance from the body cover 48 at any point around its circular body. Further, the ring member 55 is connected to the air motor 33 through the support arms 54 and the shaping air ring 41. A high voltage is applied to the ring member 55 from the high voltage generator 45 to discharge ions of the same polarity as charged paint particles from the ring member 55.

Being arranged as described above, the rotary atomizing head type coating apparatus of the second embodiment gives the following performances in an electrostatic coating operation.

As a work piece A is delivered to a position in the proximity of the robot device 21 by a conveyer or the like, the robot device 21 is put in a playback action according to uploaded teaching actions, moving the coater unit 31 to the proximity of the work piece A.

At this time, the rotary atomizing head 34 on the coater unit 31 is put in high speed rotation by the air motor 33, and paint is supplied to the rotary atomizing head 34 from the container 43 through the feed tube 44. Under the influence of centrifugal force resulting from the high speed rotation of the rotary atomizing head 34, paint is sprayed forward in the form of finely atomized particles by the coater unit 31. At the same time, the spray pattern of paint particles is controlled by shaping air which is spurted out from the shaping air ring 41.

Further, a high voltage is applied to the rotary atomizing head 34 from the high voltage generator 45 through the air motor 33. Therefore, the paint which has been supplied to the rotary atomizing head 34 is imparted with a high voltage electrostatic charge directly by the rotary atomizing head 34, and charged paint particles are urged to fly toward and deposit on the work piece A, traveling along an electrostatic field which is formed between the rotary atomizing head 34 and the work piece A which is at the earth potential.

Further, in the second embodiment, the high voltage discharge electrode assembly 53 is provided on the outer peripheral side of the body cover 48. Therefore, the high voltage from the high voltage generator 45 is applied to the ring member 55 through the air motor 33, and discharged from the ring member 55.

As a result, ions of the same polarity as charged paint particles are discharged from the high voltage discharge electrode assembly 53, certainly electrifying the cover member 47 with an electrostatic charge of the same polarity. Further, by the electrical discharge from the ring member 55 of the high voltage discharge electrode assembly 53, electrostatically attenuated paint particles can be re-electrified with a high voltage electrostatic charge. As a result, repulsion force occurs between re-electrified paint particles and the high voltage discharge electrode assembly 53 or the cover member 47, preventing deposition of paint particles on the cover member 47 in an assured manner.

Thus, in the second embodiment, the annular gap space 52 is provided between almost the entire confronting areas of the housing member 35 and the cover member 47 which confront face to face each other in the radial direction.

Generally, air is assumed to have an infinite volume resistivity, in contrast to an insulating synthetic resin material used for the housing member 35 (a dielectric material), which is approximately in the range of $10^{12}\Omega$ to $10^{16}\Omega$ in volume resistivity. Thus, as compared with air, the housing member 35 is low in volume resistivity.

Therefore, except minimal contacting portions, the cover member 47 is kept out of contact with the housing member 35 by the annular gap space 52 which is provided between these two members, to suppress leaks through the housing member 35 of high voltage electrostatic charges on the outer surface of the cover member 47. Thus, the cover member 47 can be maintained in an electrostatically charged state to prevent deposition of charged paint particles.

Further, in the case of the present embodiment, part of charged paint particles which have been sprayed from the rotary atomizing head 34 may have a tendency to float in the air around the outer periphery of the cover member 47 during a coating operation. However, since the cover member 47 can be maintained in an electrostatically charged state by the annular gap space 52, Coulomb repulsion force occurs between the electrostatic charge on the cover member 47 and floating charged paint particles, acting to stop paint particles from depositing on the cover member 47 enclosing the atomizer 32.

Furthermore, by the high voltage generator 45, a high voltage is applied to the air motor 33, the rotary atomizing head 34 and the shaping air ring 41. Therefore, high voltage electrostatic charges are built up in a stable state on outer surfaces of the cover member 47 by the air motor 33, thereby preventing deposition of paint particles.

Especially in the second embodiment, the cover member 47 is composed of the body cover 48 enclosing the main housing body 36 of the housing member 35 and the neck cover 49 enclosing the neck portion 37 of the housing member 35. That is to say, the entire outer surfaces of the housing member 35 are enshrouded by the body cover 48 and the neck cover 49. Thus, deposition of charged paint particles can be prevented by building up electrostatic charges on the outer surfaces of the body cover 48 and the neck cover 49.

Further, the cover member 47 which is formed of a fluorine-base synthetic resin film can employ, for example, PTFE with water repellent properties for the purpose of preventing deposition of charged paint particles on the outer surfaces of the cover member 47. The fluorine-base synthetic resin film of the cover member 47 can be electrified to generate a repulsion force against charged paint particles. Furthermore, the fluorine-base synthetic resin film is low in moisture absorption and high in volume resistivity, so that leaks of electrostatic charges from the cover member 47 hardly take place. Thus, the electrostatically charged state of cover member 47 can be maintained in a stable and assured manner.

In case paint deposition has occurred to the cover member 47, the filmy cover member 47 can be stripped off the housing member 35 and replaced by a fresh cover film easily. By so doing, the time for maintenance and service of the coater unit 31 can be shortened a considerable degree, permitting to carry out a coating operation with higher productivity as compared with the conventional machines which require to wash or clean a housing member 35 in the event of paint deposition.

Moreover, in the second embodiment, the high voltage discharge electrode assembly 53 is provided on the outer peripheral side of the body cover 48, and a high voltage is applied to the ring member 55 from the high voltage generator 45 through the air motor 33 and shaping air ring 41 and discharged from the ring member 55. At this time, ions of the same polarity as charged paint particles are discharged from the high voltage discharge electrode assembly 53, electrifying the cover member 47 with a high voltage electrostatic charge in an assured manner. By the electrical discharge from the ring member 55, the high voltage discharge electrode assembly 53 contributes to recharging of electrostatically attenuated paint particles.

As a consequence, a repulsion force occurs between recharged paint particles and the high voltage discharge electrode assembly 53 or the cover member 47, acting to keep charged paint particles away from the cover member 47 and thus preventing charged paint particles from depositing on the cover member 47.

Further, the high voltage discharge electrode assembly 53 which is constituted by the support arms 54 and the ring member 55 can form a high voltage electrostatic field around the cover member 47 by the ring member 55 which is located around the body cover 48, and charged paint particles are kept off the cover member 47. Further, the ring member 55 which circumvents the body cover 48 can impart a high voltage electrostatic charge to the cover member 47 by high voltage electrical discharge over a far broader areas as compared with a case where the high voltage discharge electrode assembly 53 is omitted. Thus, deposition of charged paint particles on the cover member 47 can be prevented over broader surface areas.

Figure 8:
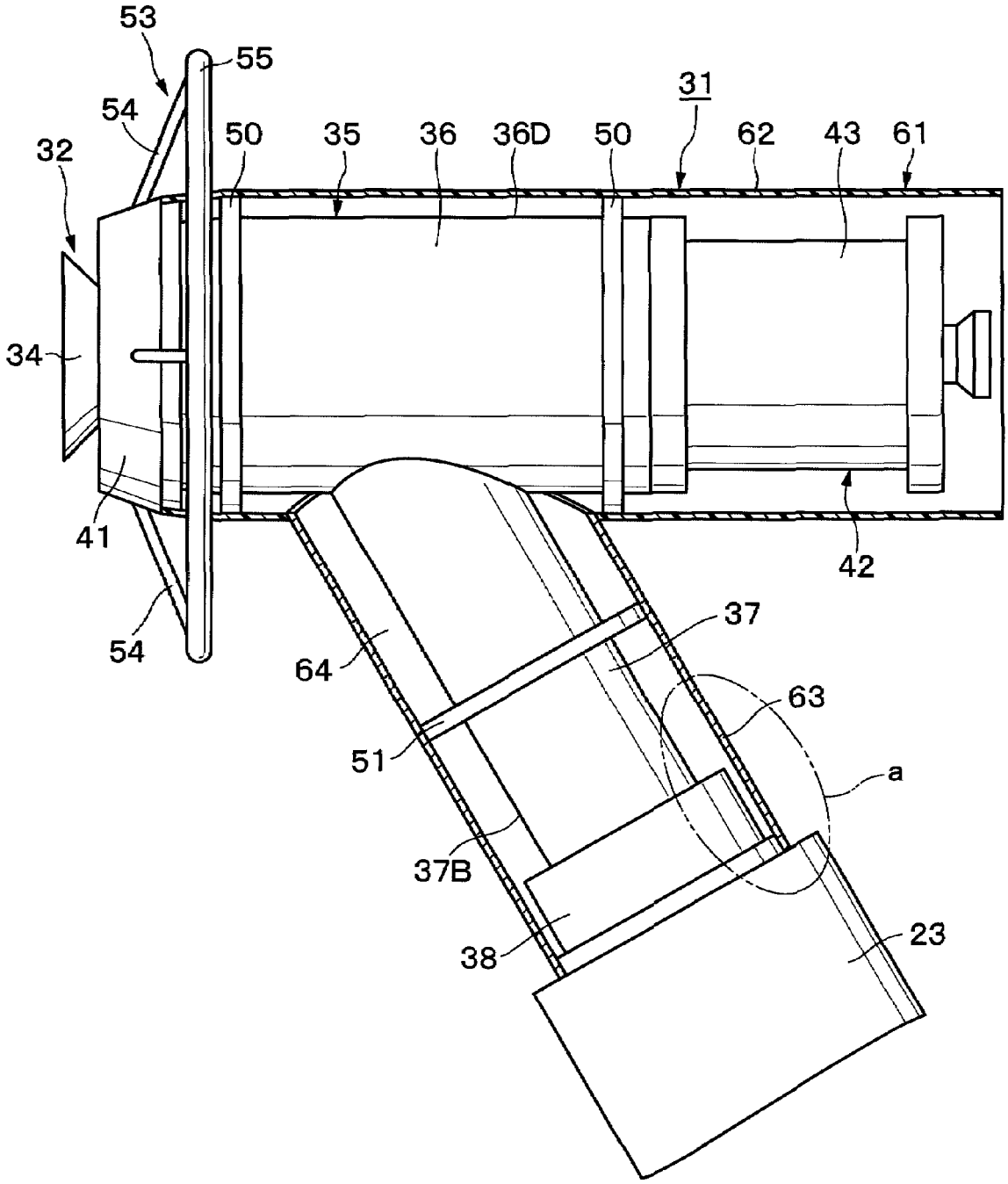
FIG. 8 is a front view in a position similar to FIG. 5 but showing a rotary atomizing head type coating apparatus according to a third embodiment of the invention.
Figure 9:
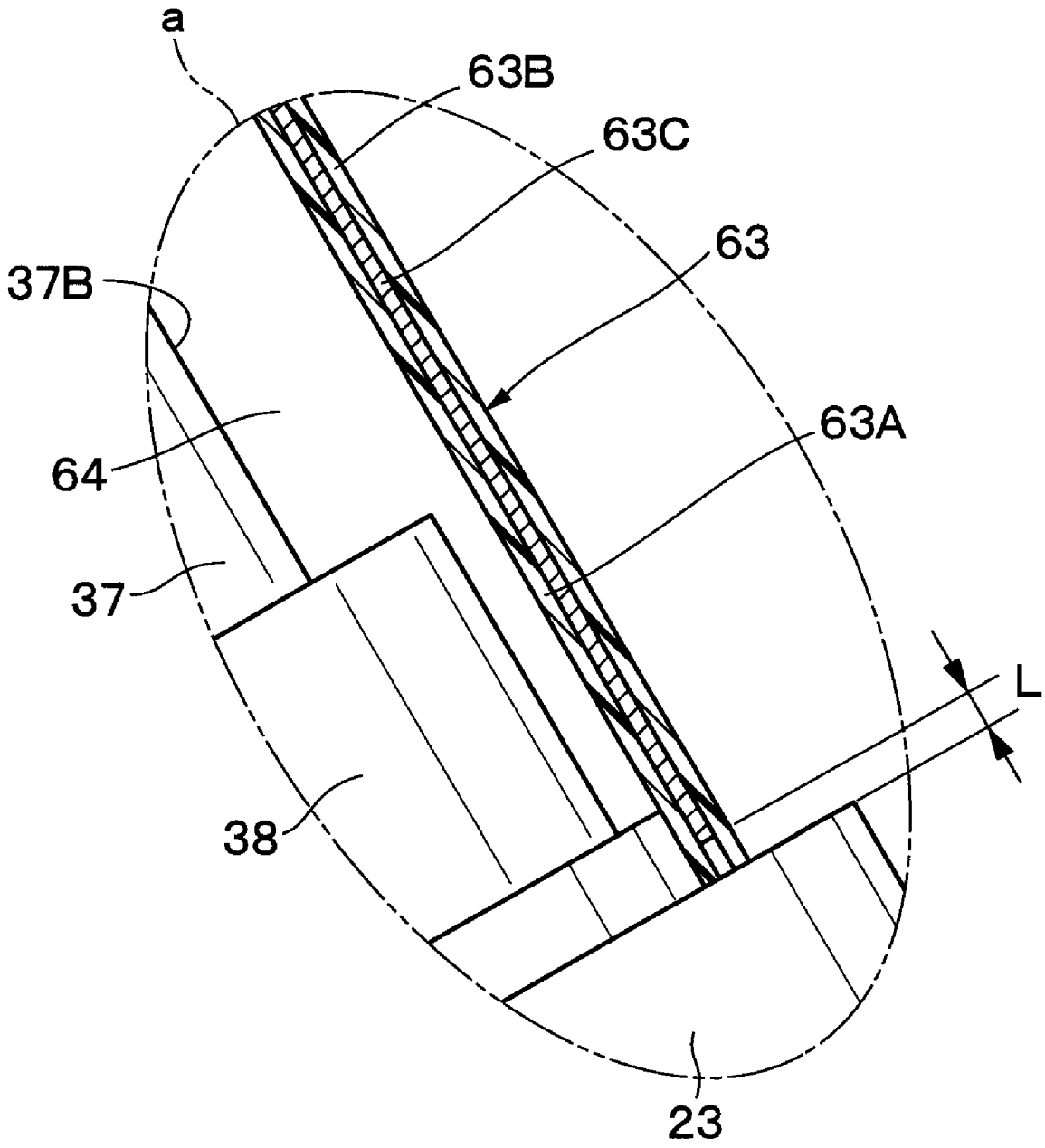
FIG. 9 is an enlarged front view showing essential parts in a demarcated area a in FIG. 8.

Now, turning to FIGS. 8 and 9, there is shown a rotary atomizing head type coating apparatus according to a third embodiment of the invention. This third embodiment has features in that a body cover is formed of a fluorine-base synthetic resin film while a neck cover is formed of a laminated film having a semi-conducting film sandwiched between two insulating films. In the following description of the third embodiment, those component parts which are identical with the counterparts in the foregoing second embodiment are simply designated by the same reference numerals or characters to avoid repetitions of same descriptions.

Indicated at 61 is a cover member which is arranged to wrap in outer surfaces of a housing member 35. This cover member 61 is composed of a body cover 62 enclosing an outer surface 36D of a main housing body 36 and a container 43, and a neck cover 63 enclosing an outer surface 37B of a neck portion 37.

In this instance, similarly to the body cover 48 in the second embodiment, the body cover 62 is formed of a fluorine-base synthetic resin film, for example, a PTFE film.

On the other hand, the neck cover 63 is formed of a laminated film material having a semi-conducting film 63C sandwiched between two insulating films 63A and 63B. In this case, the insulating films 63A and 63B are formed, for example, by the use of a fluorine-base synthetic resin material like PTFE with a volume resistivity greater than, for example, $10^{16}\Omega$. On the other hand, the semi-conducting film 63C is formed by the use of a synthetic resin material like polyethylene which is lower in resistivity than the insulating films 63A and 63B, for example, a synthetic resin material having a volume resistivity lower than $10^{11}\Omega$. In this regard, these films 63A, 63B and 63C are preferred to have a thickness in the range of 0.1 mm to 1.0 mm, more preferably, a thickness in the range of 0.1 mm to 0.3 mm.

In this case, the body cover 62 is fitted and attached on annular flanges 50 which are provided at fore and rear longitudinal ends of the main housing body 36. On the other hand, the neck cover 63 is fitted and attached on an annular flange 51, which is provided at a longitudinally intermediate portion of the neck portion 37, and a connector member 38 which is provided at the lower proximal end of the neck portion 37. Almost the entire areas of the body cover 62 which confront face to face with an outer surface 36D of the main housing body 36 are radially spaced from the main housing body 36 except for minimal areas which are in contact with the flanges 50.

Further, almost the entire areas of the neck cover 63 which confront face to face with the outer surface 37B of the neck portion 37 are radially spaced from the neck portion 37 except for minimal areas which are in contact with the flange 51 and connector member 38. Thus, similarly to the annular gap space 52 in the second embodiment, an annular gap space 64 is formed between almost the entire confronting areas of the cover member 61 and the housing member 35. As a result, on the outer peripheral side, the air motor and high voltage generator are almost entirely circumvented by the annular gap space 64.

Further, the distal end of the neck cover 63 is extended toward the proximal end of the neck portion 37 and held in contact with the robot arm 23. However, at the distal end of the neck cover 63, there is a void space between the semi-conducting film 63C and the robot arm 23 by removal of an end portion of the semi-conducting film 63C. Namely, as shown in FIG. 9, the insulating films 63A and 63B of the neck cover 63 are held in contact with the robot arm 23, but the semi-conducting film 63C is cut short of and spaced from the robot arm 23 by a distance L greater than 10 mm. Thus, electrostatic charges on the semi-conducting film 63C of the neck cover 63 are prevented from being discharged to the side of the robot arm 23 which is at the earth potential.

With the arrangements as described above, the third embodiment of the invention can produce the same operational effects as the foregoing second embodiment. Especially in the case of the third embodiment, the body cover 62 is formed of a fluorine-base synthetic resin material while the neck cover 63 is formed of a laminated film material. In this case, a high voltage is applied to the atomizer 32, shaping air ring 41 and high voltage discharge electrode assembly 53 from the high voltage generator 45. Therefore, the body cover 62 which is located in the proximity of the atomizer 32 is easily electrified by an electrostatic charge. That is to say, in this case, paint deposition on the body cover 62 can be easily suppressed.

In contrast, the neck cover 63 which is located at a greater distance from the atomizer 32 is less susceptible to electrification. In this regard, even if a wind of electrons or negative ions is uniformly blasted against the cover member 61, there is no guarantee that the surface of the cover member 61 will be electrified uniformly with an electrostatic charge. That is to say, uniformity of electrostatic charges which deposit on the surface of the cover member 61 largely depends on the potential within the cover member 61. At this time, while the upper end of the neck portion 37 of the housing member 35 is at a high potential by the influence of the high voltage generator 45, the lower proximal end of the neck portion 37 is held at the earth potential by the robot arm 23. Therefore, uniformity of electrostatic charges on the neck cover 63 is disturbed by the gradient of potential of the neck portion 37. Therefore, there is a trend that the neck cover 63 is electrified with electrostatic charges far more easily on the side of the atomizer 32 as compared with those areas which are distant from the atomizer 32.

However, according to the third embodiment of the invention, the neck cover 63 is formed of a laminated film having a semi-conducting film 63C sandwiched between two insulating films 63A and 63B. In this case, electrostatic charges can migrate more easily in the semi-conducting film 63C which is smaller in volume resistivity as compared with the insulating films 63A and 63B. In a DC electric field, the semi-conducting film 63C which is sufficiently low in electric resistivity as compared with the insulating films 63A and 63B is held at the same potential in all of its localities. This stability in potential of the underlying semi-conducting film 63C has an effect of electrifying surfaces of the insulating film 63A uniformly with an electrostatic charge.

Namely, in case an electric charge of negative polarity is built up on the front side of the insulating film 63A as a result of static electrification, an electric charges of positive polarity occurs on the back side of the insulating film 63A due to dielectric electrification phenomenon. At this time, since the semi-conducting film 63C is provided on the back side of the insulating film 63A, positive electric charges on the back side of the insulating film 63 tend to spread over the entire neck cover 63 through the semi-conducting film 63C. Concurrently, negative electric charges on the front side of the insulating film 63A are urged to spread over uniformly the entire neck cover 63 under the influence of the Coulomb force occurring between negative and positive electric charges.

Thus, the provision of the semi-conducting film 63C helps to electrify the surface of the insulating film 63A uniformly with negative charges in an assured manner. Therefore, when negative ions come flying toward the insulating film 63A, a build up of electrostatic charges takes place uniformly over the entire surface of the insulating film 63A.

As a consequence, it becomes possible to impart electrostatic charges to the entire surfaces of the neck cover 63 in an assured manner for preventing deposition of charged paint particles, and to prevent a concentration of electric field due to non-uniform distribution of electrostatic charges. This means that a repulsion force can be generated between the insulating film 63A and a charged paint particle in a stable state to prevent smears by partial or localized paint deposits.

Figure 10:
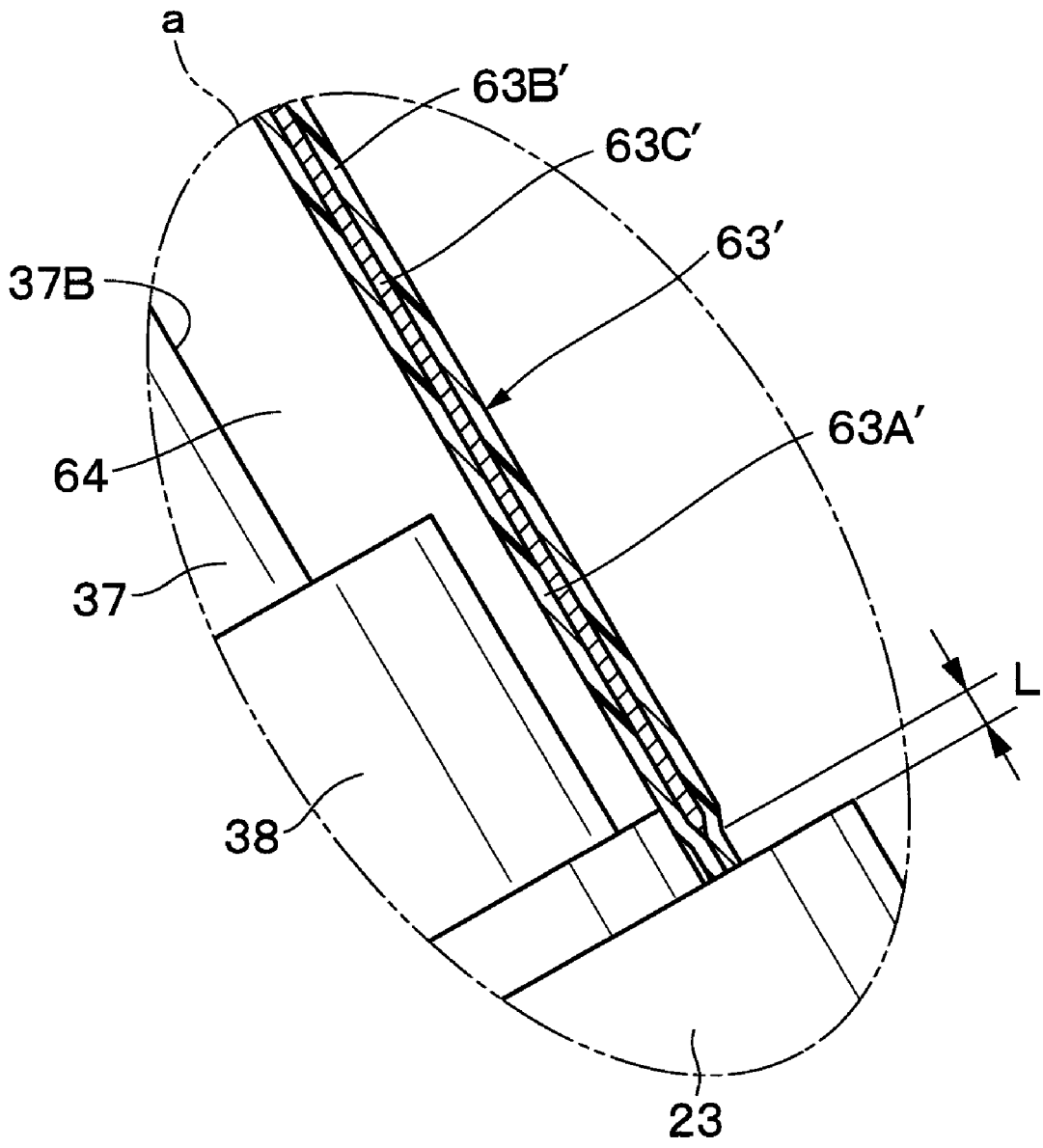
FIG. 10 is an enlarged front view in a position similar to FIG. 9 but showing a neck cover in a second modification.

Further, in the third embodiment of the invention, the semi-conducting film 63C is partly removed at the lower distal end of the neck cover 63, insulating the semi-conducting film 63C from the robot arm 23. However, the present invention is not limited to this particular arrangement. For example, as exemplified in a second modification of FIG. 10, a semi-conducting film 63C' can be insulated from the robot arm 23 by welding marginal end portions of insulating films 63A' and 63B' at the lower distal end of a neck cover 63'.

Figure 11:
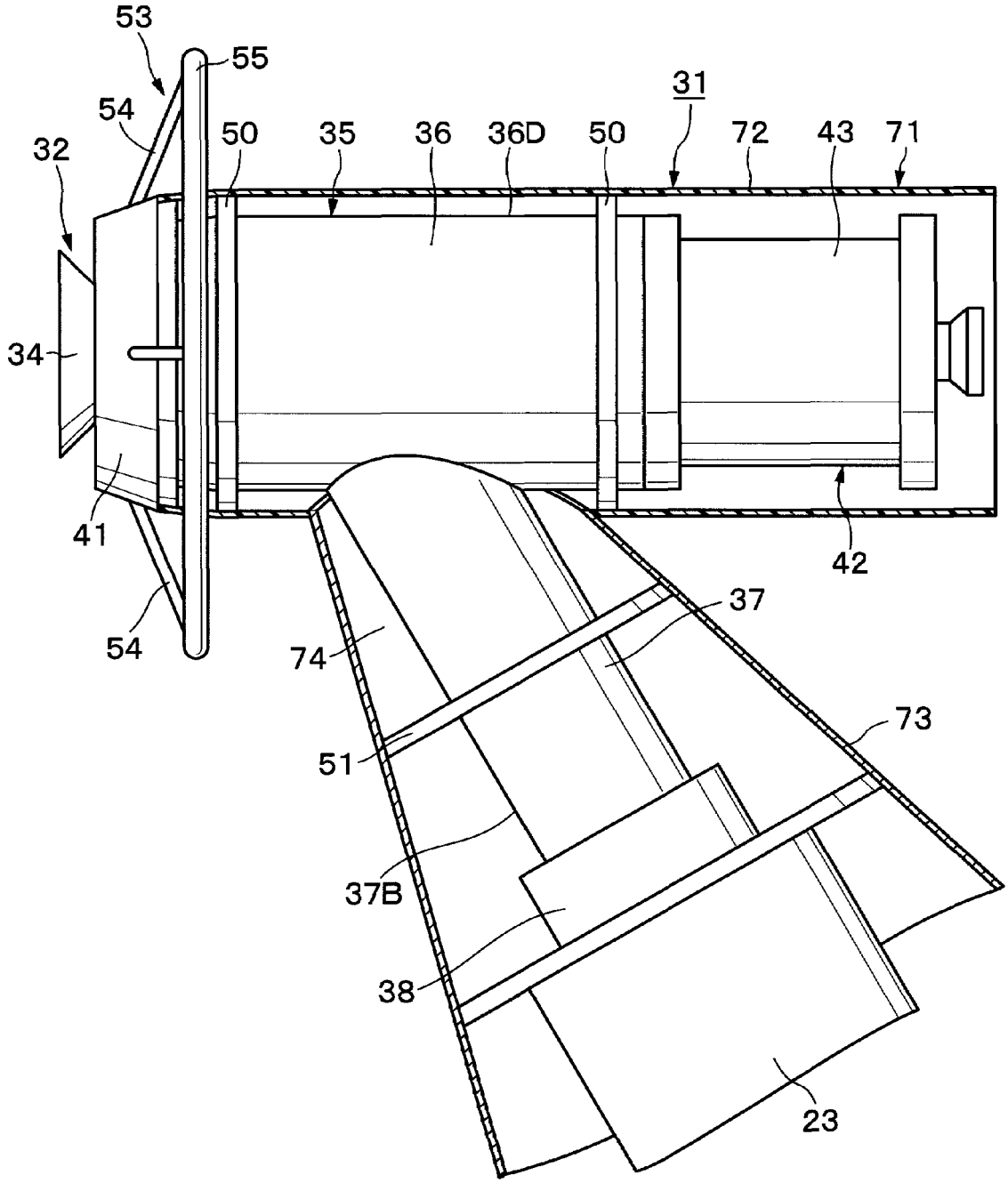
FIG. 11 is a front view in a position similar to FIG. 5 but showing a rotary atomizing head type coating apparatus according to a fourth embodiment of the invention.

Shown in FIG. 11 is a rotary atomizing head type coating apparatus according to a fourth embodiment of the present invention. This fourth embodiment of the invention has a feature in that a neck cover is extended toward a robot arm beyond the lower proximate end of the neck portion of the housing member and arranged to enshroud the robot arm as well. In the following description of the fourth embodiment, those component parts which are identical with the counterparts in the foregoing second embodiment are simply designated by the same reference numerals or characters to avoid repetitions of same explanations.

Indicated at 71 is a cover member which is arranged to enshroud outer surfaces of the housing member 35. This cover member 71 is composed of a body cover 72 enshrouding the outer surface 36D of the main housing body 36 as well as outer surface of the container 43 of a paint cartridge, and a neck cover 73 enshrouding the outer surface 37B of the neck portion 37. Similarly to the body cover 48 in the second embodiment, the body cover 72 is formed of a film of a fluorine-base synthetic resin material, for example, such as PTFE. On the other hand, substantially in the same way as the neck cover 63 in the third embodiment, the neck cover 73 is formed of a laminated film material having a semi-conducting film sandwiched between two insulating films.

In this instance, the body cover 72 is fitted and attached on annular flanges 50 which are provided at fore and rear ends of the main housing body 36, and the neck cover 73 is fitted and attached on an annular flange 51, which is provided in a longitudinally intermediate portion of the neck portion 37, and a connector member 38 which is provided at a lower proximal end of the neck portion 37. Except minimal areas which are in contact with the flanges 50, almost entire areas of the body cover 72 which radially confront face to face with outer surface 36D of the main housing body 36 are radially spaced from and kept out of contact with the latter.

Further, except minimal areas which are in contact with the flange 51 and connector member 38, almost entire areas of the neck cover 73 which radially confront face to face with the outer surface 37B of the neck portion 37 are radially spaced from and kept out of contact with the latter. Thus, similarly to the annular gap space 52 in the second embodiment, an annular gap space 74 is formed between almost the entire confronting areas of the cover member 71 and the housing member 35. As a result, on the outer peripheral side, the air motor and high voltage generator are almost entirely circumvented by the annular gap space 74.

Furthermore, the neck cover 73 is extended beyond the neck portion 37 onto the robot arm 23 to circumvent a fore end portion of the robot arm 23. Besides, the neck cover 73 is gradually spread in diameter in a direction toward its lower distal end, presenting a bell-like shape. Namely, the neck cover 73 is spread in diameter toward and radially spaced from a fore end portion of the robot arm 23 which is at the earth potential. Keeping a sufficient distance of insulation from the robot arm 23, the neck cover 73 functions to prevent discharges and leaks of electrostatic charges toward the robot arm 23.

Thus, the fourth embodiment can produce substantially the same operational effects as the foregoing second and third embodiments. Especially in the case of the fourth embodiment, the lower end of the neck cover 73 is arranged to enshroud a fore end portion of the robot arm 23 as well, by extending the neck cover 73 beyond the neck portion 37 of the housing member 35 toward and around the robot arm 23 which is at the earth potential. The extended end of the neck cover 73 is spaced from and kept out of contact with the robot arm 23 which is at the earth potential.

Therefore, even if surfaces of the neck cover 73 are smeared by paint to a certain degree, there is no possibility of leaks of electrostatic charges between the lower distal end of the neck cover 73 and the robot arm 23. Besides, since the neck cover 73 is fitted around the neck portion 37 of the housing member 35, there is no possibility of the back side of the neck cover 73 being directly exposed to floating paint particles in the ambient atmosphere. That is to say, there is little chance of the back side of the neck cover 73 being smeared by paint to such a degree as to cause leaks of electrostatic charges from the back side of the neck cover 73. Therefore, the neck cover 73 is retained in an electrified state in an assured manner, preventing progress of smudges by paint.

On the other hand, in case the lower distal end of the neck cover 63 is brought into contact with the robot arm 23 as in the foregoing third embodiment, for example, paint deposits on the surface of the neck cover 63 cause a drop in electric resistivity to the surface of the neck cover 63. As a result, electrostatic charges on the side of the neck cover 63 tend to leak through a part which is in contact with the robot arm 23 on the side of the earth ground, lowering the repulsion force between the neck cover 63 and charged paint particles and bringing about a situation in which paint can deposit easily.

Further, the neck cover 73 is arranged to enshroud the outer periphery of the robot arm 23 as well, preventing charged paint particles from depositing on the robot arm 23 even if the robot arm 23 is at the earth potential.

Figure 12:
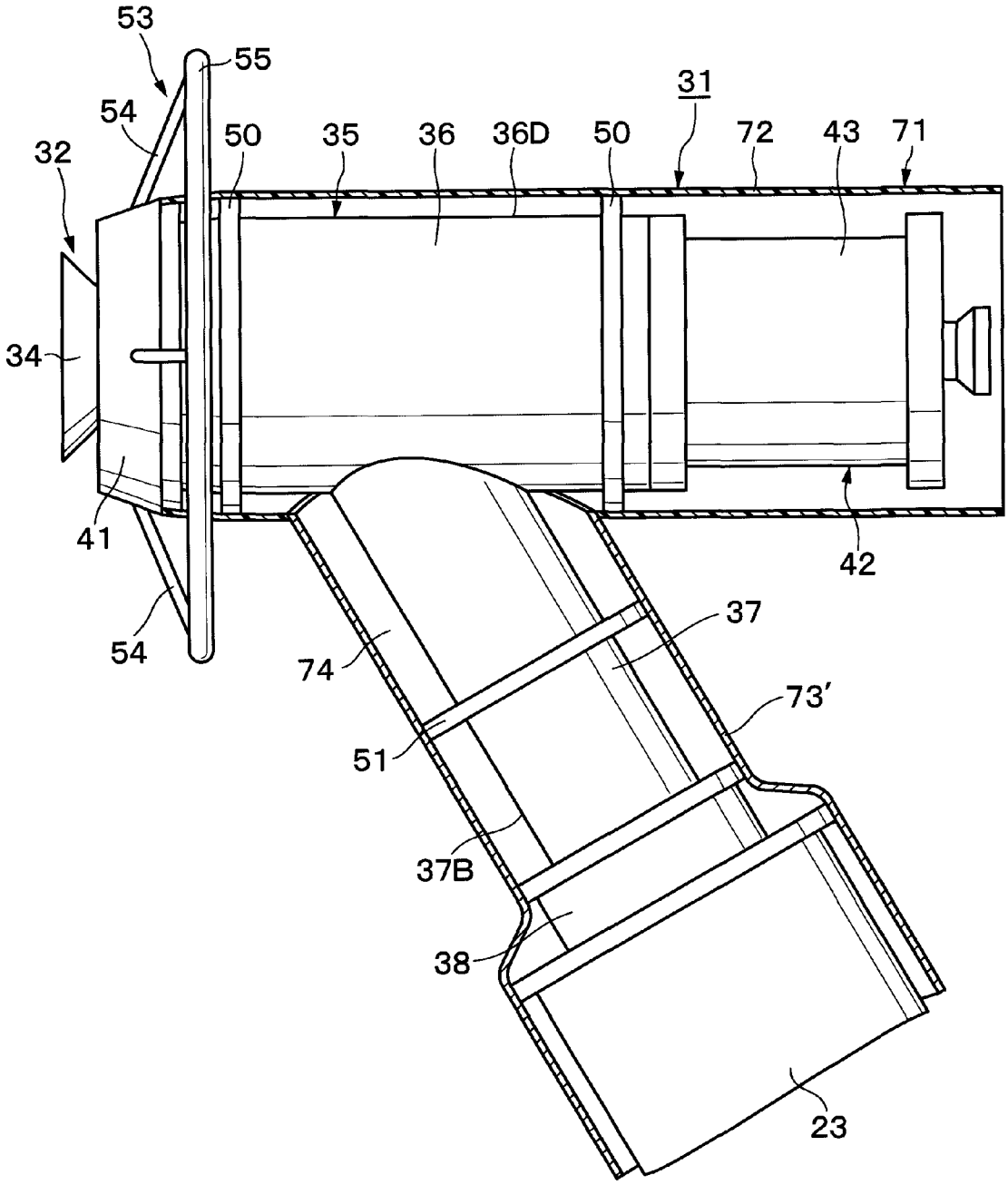
FIG. 12 is a front view in a position similar to FIG. 5 but showing a rotary atomizing head type coating apparatus according to a third modification.

Furthermore, in the fourth embodiment, the neck cover 73 is gradually spread in diameter in a direction toward the robot arm 23, presenting a bell-like shape, and as a result spaced from the robot arm 23 in the radial direction. However, it is to be understood that the present invention is not limited to this particular arrangement. For example, as in a third modification of FIG. 12, there may be employed a neck cover 73' of a straight tubular shape which is fitted around the robot arm 23 keeping a constant distance from the robot arm in the axial direction.

Figure 13:
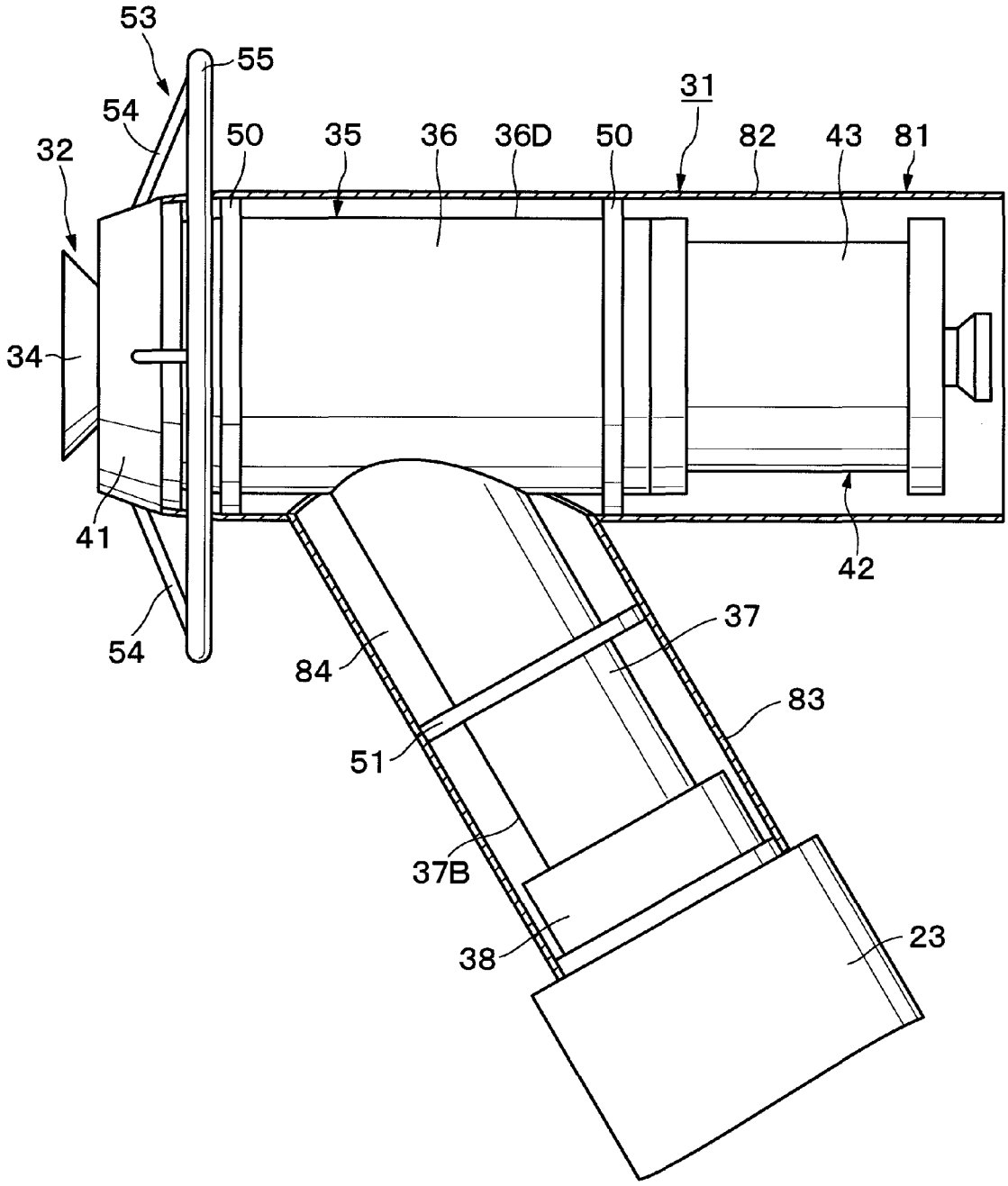
FIG. 13 is a front view in a position similar to FIG. 5 but showing a rotary atomizing head type coating apparatus according to a fifth embodiment of the invention.

Now, turning to FIG. 13, there is shown a rotary atomizing head type coating apparatus according to a fifth embodiment of the invention. This fifth embodiment has a feature in that a cover member is entirely formed of laminated film material. In the following description of the fifth embodiment, those component parts which are identical with the counterparts in the foregoing second embodiment are simply designated by the same reference numerals or characters to avoid repetitions of same explanations.

Indicated at 81 is a cover member which is fitted around the housing member 35 to cover the outer surfaces of the latter. Substantially in the same way as the neck cover 63 in the third embodiment, this cover member 81 is formed of a laminated film material having a semi-conducting film sandwiched between two insulating films. The cover member 81 is composed of a body cover 82 enclosing outer surface 36D of the main housing body 36 and a neck cover 83 enclosing outer surface 37B of the neck portion 37. Similarly to the annular gap space 52 in the second embodiment, an annular gap space 84 is formed between almost the entire confronting areas of the cover member 81 and the housing member 35.

Thus, the fifth embodiment of the invention can produce substantially the same operational effects as the second and third embodiments. Especially in the case of the fifth embodiment employing the cover member 81 which is entirely formed of a laminated film, even when electric charges are hardly built up on part of the cover member 81 due to a gradient of potential in the housing member 35, for example, the entire semi-conducting film of the cover member 81 can be stabilized almost at the same potential to suppress the influence of the gradient of potential in the housing member 35.

As a consequence, when negative ions come flying toward the cover member 81, electrostatic charges can be built up uniformly on the entire surfaces of the outer insulating film of the cover member 81 in an assured manner. That is to say, the entire cover member 81 is electrified in an assured manner to prevent deposition of charged paint particles and concentration of electric field as caused by uneven distribution of electrostatic charges, precluding partial or localized paint depositions or accumulation.

Figure 14:
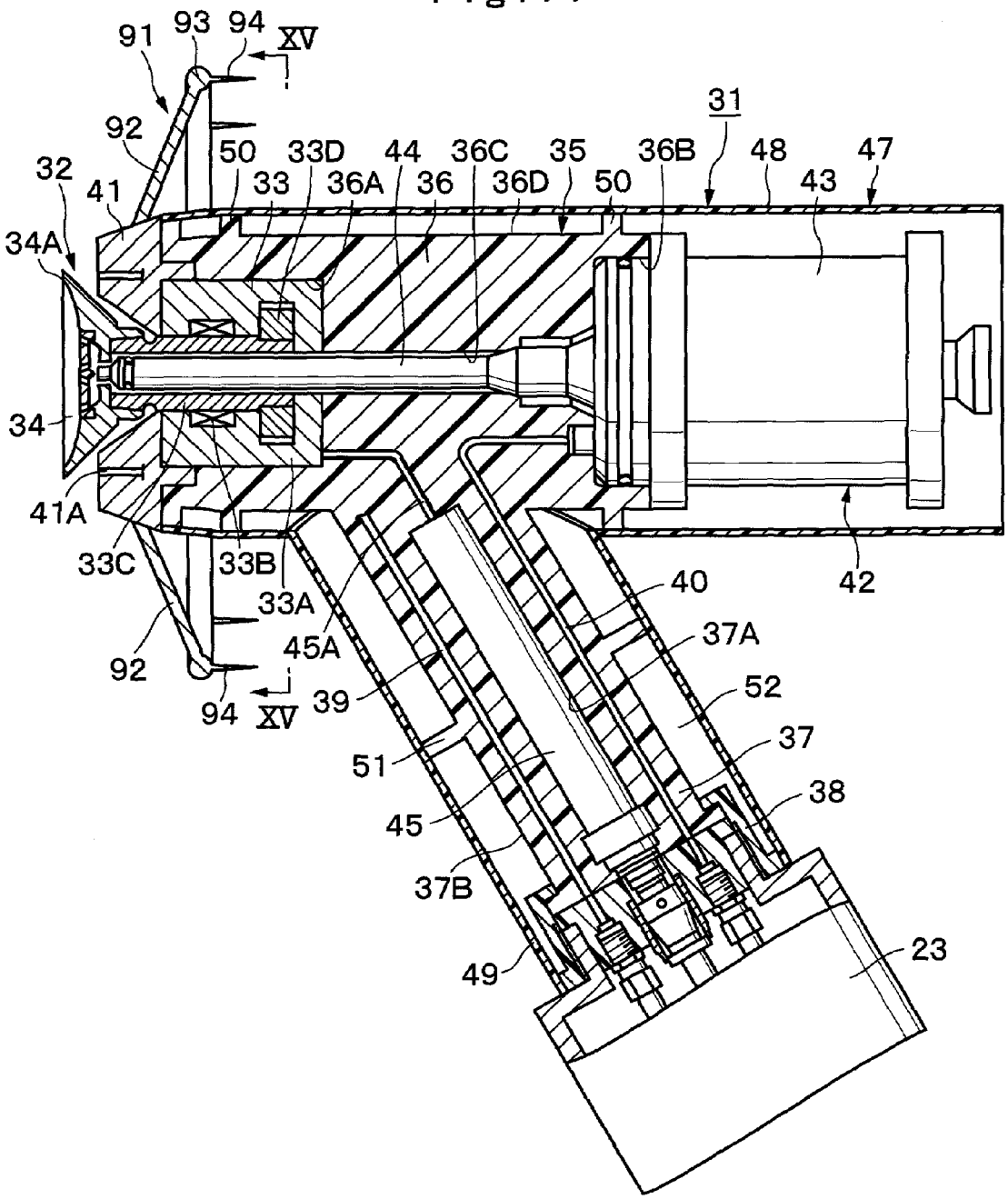
FIG. 14 is a longitudinal sectional view of a rotary atomizing head type coating apparatus according to a sixth embodiment of the invention.
Figure 15:
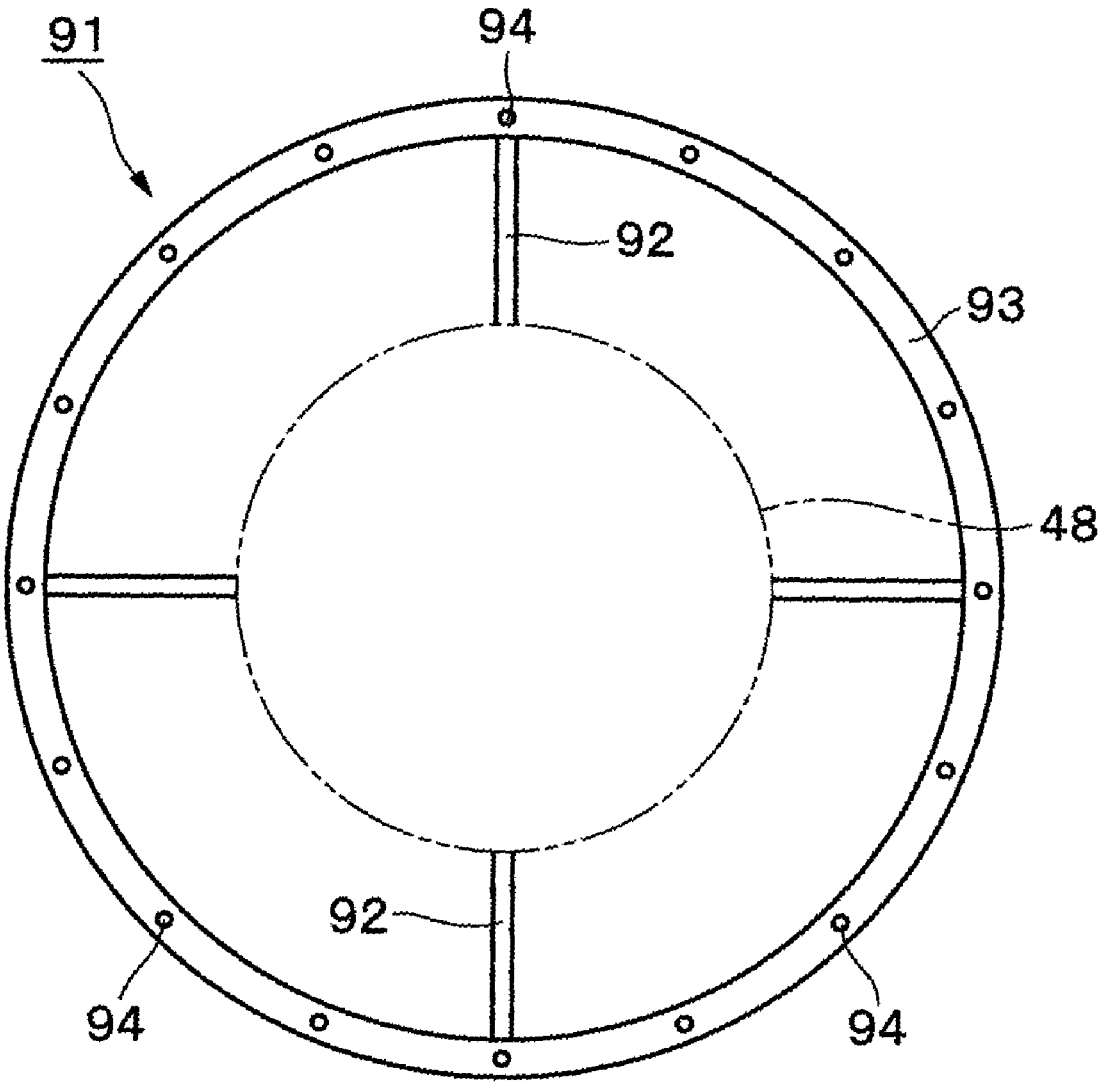
FIG. 15 is a right-hand side view of a high voltage discharge electrode assembly adopted in the sixth embodiment, taken from the direction of arrows XV-XV in FIG. 14.

Now, turning to FIGS. 14 and 15, there is shown a rotary atomizing head type coating apparatus according to a sixth embodiment of the invention. This sixth embodiment has a feature in that acicular electrode members are provided on a ring member of a high voltage discharge electrode assembly, the acicular electrode members being extended in a direction away from a work piece. In the following description of the sixth embodiment, those component parts which are identical with the counterparts in the foregoing second embodiment are simply designated by the same reference numerals or characters to avoid repetitions of same explanations.

Indicated at 91 is a high voltage discharge electrode assembly which is provided on the outer peripheral side of a body cover 48. This high voltage discharge electrode assembly is formed of a conducting material and composed of support arms 92, a ring member 93 and electrode members 94, which will be described hereinafter.

Denoted at 92 are radial support arms which are located around the outer periphery of a shaping air ring 41. These support arms 92 are extended radially outward from the side of a housing member 35 toward a point on the outer peripheral side of the body cover 48. Further, a plural number of support arms 92, for example, four support arms 92 are located at uniform angular intervals around the shaping air ring 41 to support a ring member 93 on their outer distal ends.

Indicated at 93 is a ring member which is supported on outer distal ends of the support arms 92. This ring member 93 is formed, for example, in the shape of a circular ring by the use of an electrically conducting material like a metal. Further, the ring member 93 is positioned around the air motor 33 in such a way as to circumvent a front portion of the body cover 48. Furthermore, the ring member 93 is formed in a circular shape which is larger than outside diameter of the body cover 48 and positioned substantially in concentric or coaxial relation with the rotational shaft 33C of the air motor 33. Thus, all around the circular body, the ring member 93 is positioned constantly at the same distance from the body cover 48. Further, the ring member 93 is connected to the air motor 33 through the support arms 92 and shaping air ring 41. Therefore, from the high voltage generator 45, a high voltage is applied to the ring member 93.

Denoted at 94 are electrode members which are provided on the ring member 93. These electrode members 94 are extended out from the ring member 93 in a direction away from a work piece (in rearward direction), and are each in the form of an acicular electrode formed of an electrically conducting material like a metal. A plural number of electrode members 94 are provided in equidistant positions on the round body of the ring member 93. Relative to the axis of the air motor (the rotational shaft), each one of the electrode members 94 is extended in a parallel direction or with an angle of depression in the range of 10° or an angle of elevation in the range of 20°.

Thus, the sixth embodiment of the invention can produce substantially the same operational effects as the second embodiment. Especially in the case of the sixth embodiment having electrode members 94 provided on the ring member 93, an electric field can be concentrated at the distal end of each electrode member 94 to discharge a high voltage easily in a stabilized manner. Further, as a high voltage is discharged from the distal end of the electrode members 94 which are extended in a direction away from a work piece, the cover member 47 is imparted with a high voltage electrostatic charge up to its rear end portions. Thus, deposition of charged paint particles can be prevented on broader areas of the cover member 47.

Figure 16:
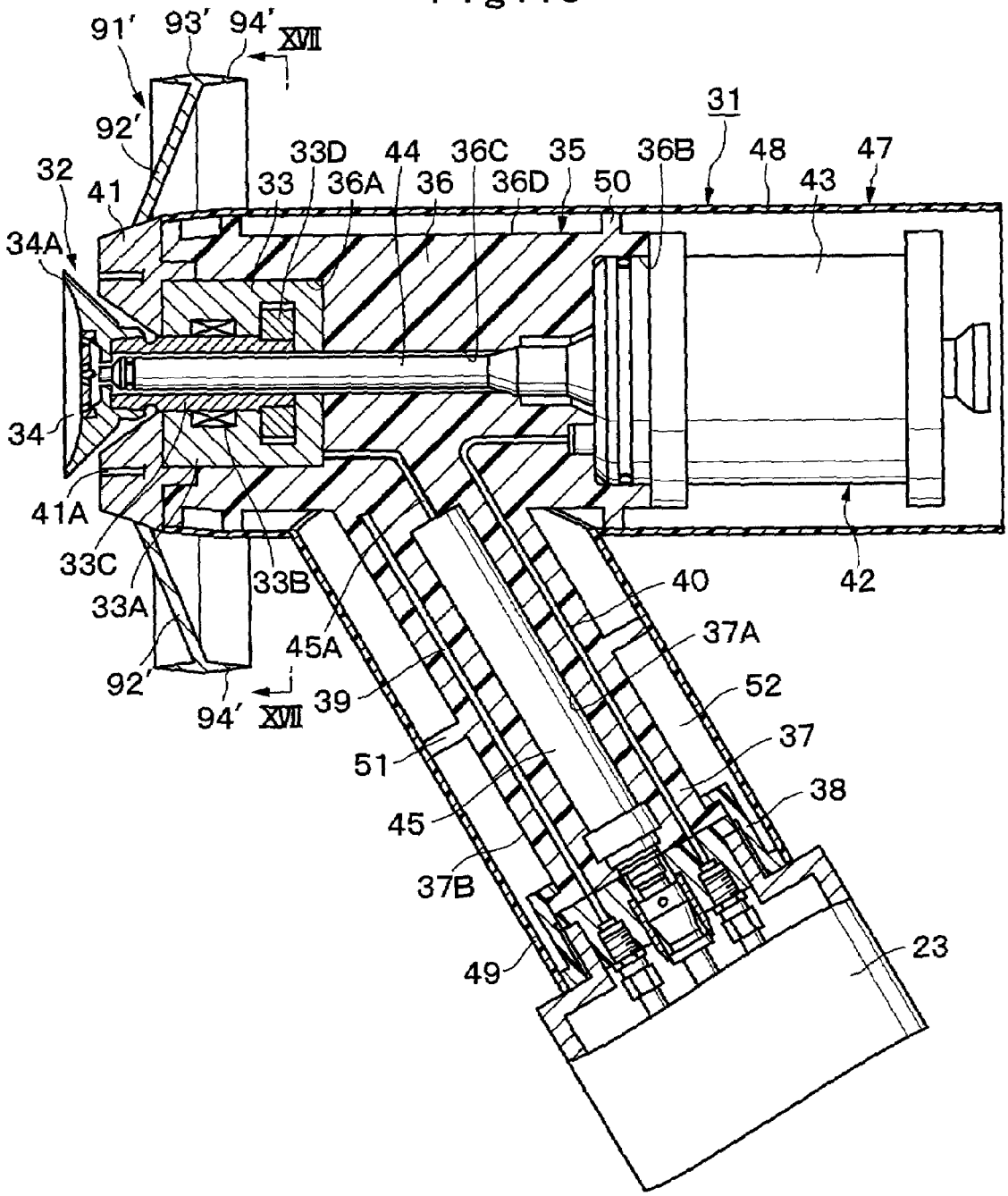
FIG. 16 is a longitudinal sectional view of a rotary atomizing head type coating apparatus according to a fourth modification.
Figure 17:
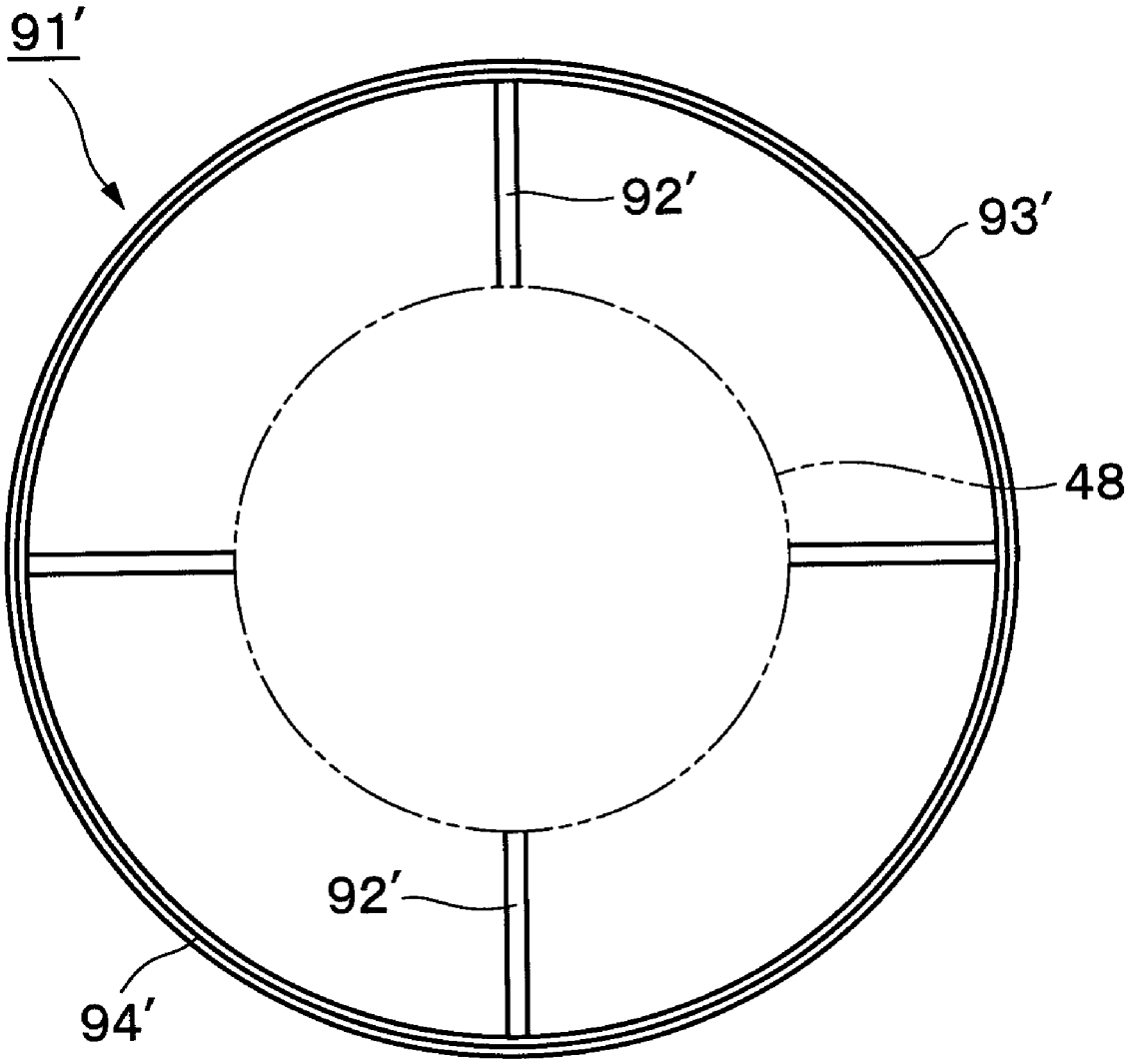
FIG. 17 is a right-hand side view of a high voltage discharge electrode assembly adopted in the fourth modification, taken from the direction of arrows XVII-XVII in FIG. 16.

In the sixth embodiment, a plural number of acicular electrode members 94 are provided on the ring member 93. However, the present invention is not limited to this particular arrangement. For example, there may be employed a discharge ring as in the fourth modification shown in FIGS. 16 and 17. Namely, in this case, a discharge ring is constituted by a ring member 93' and an electrode member 94' in the form of a circular blade which is projected rearward from all around the ring member 93'. In this case, the blade electrode member 94' can be formed simply folding a single blade into a circular ring. The electrode member 94' in the shape of a blade may be provided on both of front and rear sides of the ring member 93', that is, on the side facing toward a work piece and on the other side facing away from a work piece. Alternatively, the blade-like electrode member 94' may be provided only on the rear side of the ring member 93', that is, only on the side away from a work piece.

Figure 18:
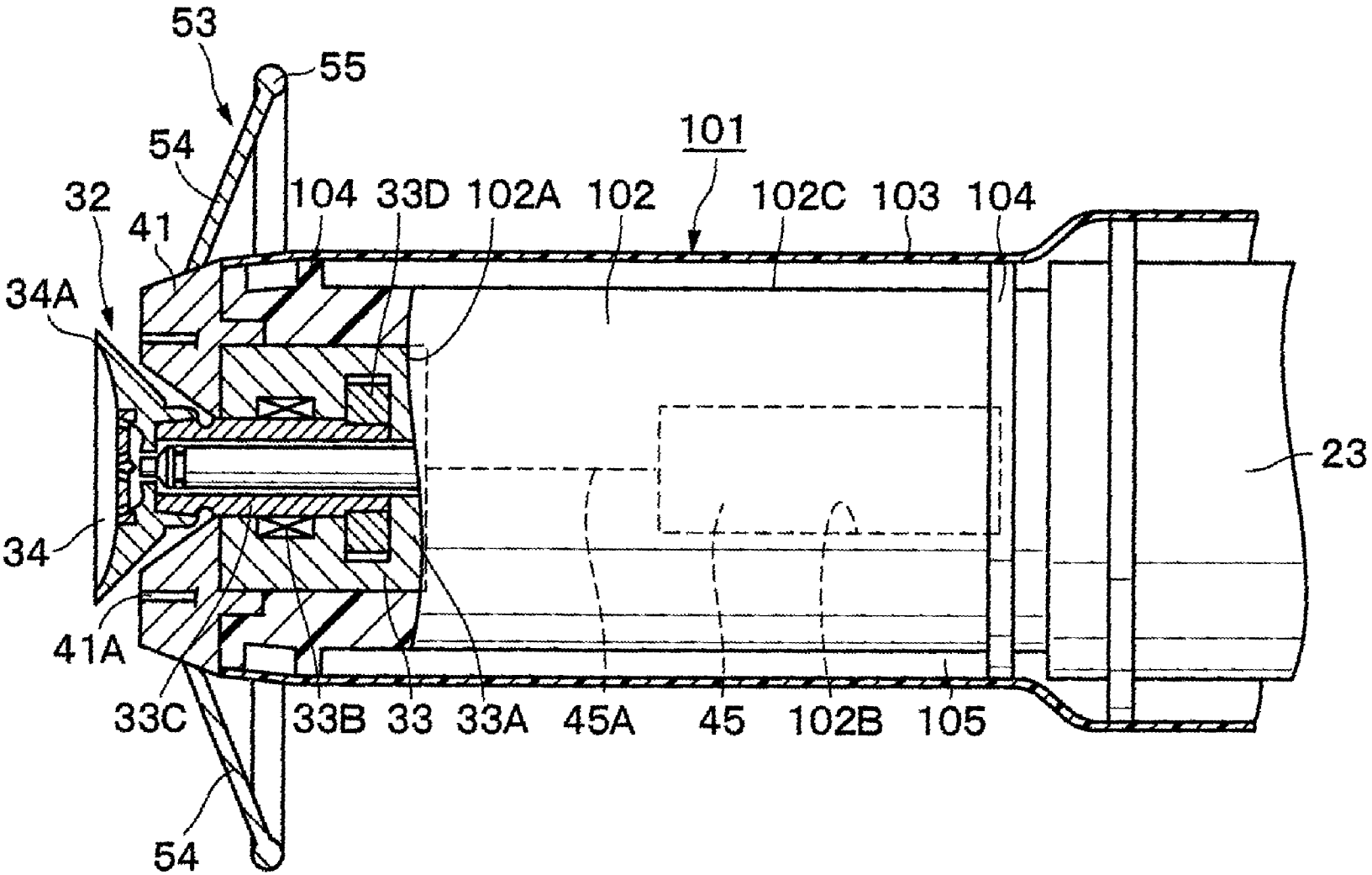
FIG. 18 is a partly cutaway front view of a rotary atomizing head type coating apparatus according to a seventh embodiment of the invention, part of a cover member being cut away.

Now, turning to FIG. 18, there is shown a rotary atomizing head type coating apparatus according to a seventh embodiment of the invention. This embodiment has a feature in that the coater unit is attached to a robot arm by way of a housing member which has no branched neck portion. In the following description of the seventh embodiment, those component parts which are identical with the counterparts in the foregoing second embodiment are simply designated by the same reference numerals or characters to avoid repetitions of same explanations.

Indicated at 101 is a coater unit according to the seventh embodiment. This coater unit 101 is attached to a fore distal end of a robot arm 23, and largely constituted by an atomizer 32 and a housing member 102.

Indicated at 102 is a housing member adopted in the seventh embodiment. Substantially in the same way as the housing member 9 in the first embodiment, this housing member 102 is formed generally in a cylindrical shape by the use of an electrically insulating synthetic resin material, and adapted to accommodate an atomizer 32 and a high-voltage generator 45. A motor receptacle hole 102A is formed internally of a front side portion of the housing member 102 to accommodate an air motor 33, while a generator receptacle hole 102B is provided internally of a rear side portion of the housing member 102 to accommodate a high voltage generator 45.

Further, a shaping air ring 41 of a conducting metallic material is attached to the fore end of the housing member 102. In turn, rear end of the housing member 102 attached to a fore distal end of a robot arm 23. Further, located on the outer peripheral side of the shaping air ring 41 is a high voltage discharge electrode assembly 53 which is constituted by support arms 54 and a ring member 55.

Denoted at 103 is a cover member of a tubular shape which is fitted on in such a way as to enshroud outer surface 102C of the housing member 102. For example, substantially in the same way as the cover member 47 in the foregoing second embodiment, this cover member 103 is formed in a tubular shape by the use of a fluorine-base synthetic resin film material, and extended axially along the housing member 102 as far as a position around a fore distal end of the robot arm 23. Thus, similarly to the cover member 71 in the fourth embodiment, the cover member 103 is arranged to enshroud the outer surface 102C of the housing member 102 and the outer surface of the robot arm 23 as well.

The cover member 103 is fitted on and attached to annular flanges 104 which are provided around fore and rear end portions of the housing member 102. Except minimal areas which are in contact with the flanges 104, almost entire areas of the cover member 103 which are disposed face to face with the outer surface 102C of the housing member 102 are spaced from and kept out of contact with the housing member 102. Thus, an annular gap space 105, which is an annular shape in cross section, is formed between almost entire confronting areas of the cover member 103 and housing member 102. As a consequence, on the outer peripheral side, the air motor 33 and high voltage generator 45 are almost entirely circumvented by the annular gap space 105.

Thus, the seventh embodiment of the invention can produce substantially the same operational effects as the second and fourth embodiments.

Figure 19:
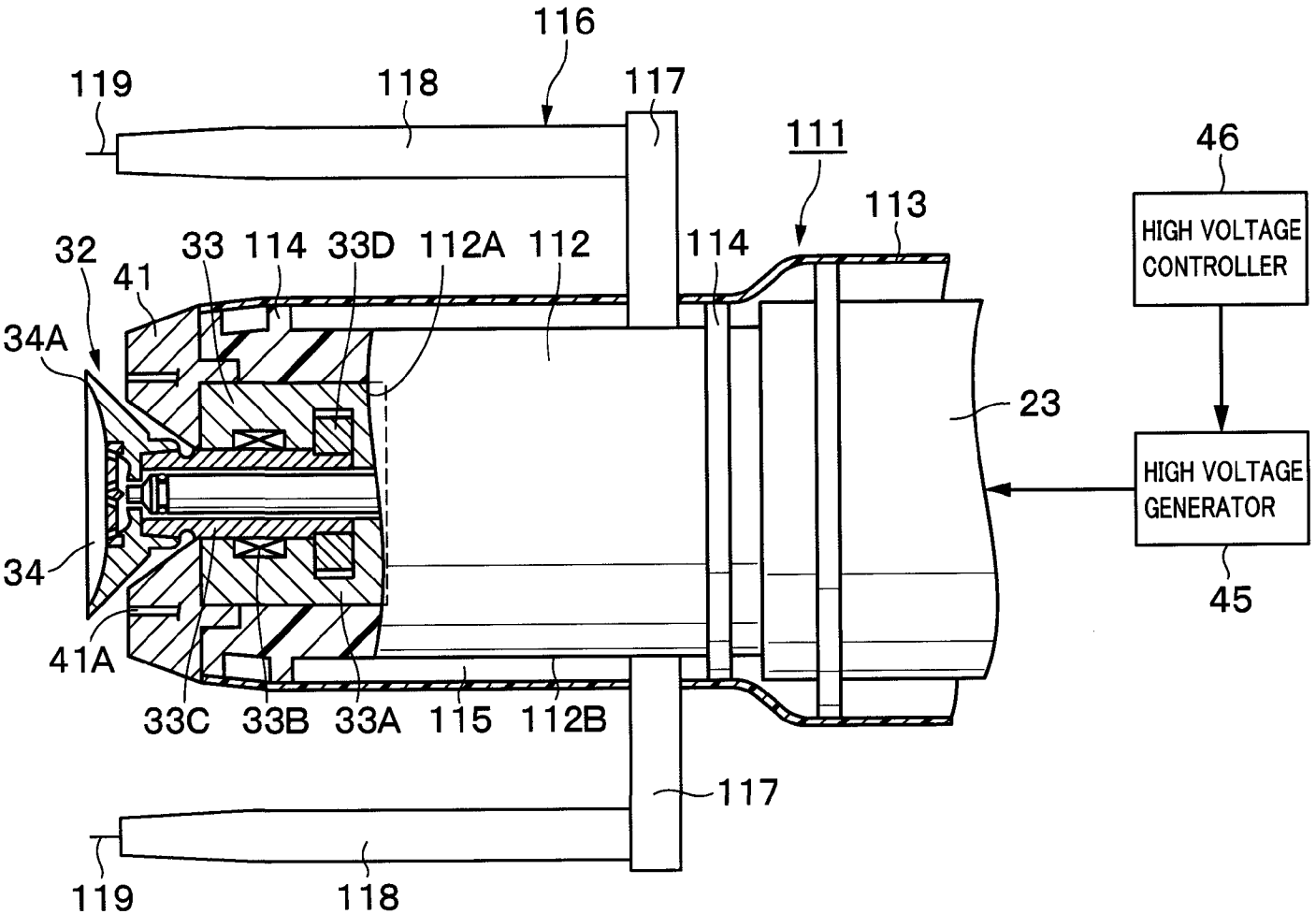
FIG. 19 is a partly cutaway front view of a rotary atomizing head type coating apparatus according to an eighth embodiment of the invention, part of a cover member being cut away.

Now, turning to FIG. 19, there is shown a rotary atomizing head type coating apparatus according to an eighth embodiment of the invention. This embodiment has a feature in that a high voltage generator is adapted to apply a high voltage to an external electrode assembly which is located on the outer peripheral side of a cover member. In the following description of the eighth embodiment, those component parts which are identical with the counterparts in the foregoing second embodiments are simply designated by the same reference numerals or characters to avoid repetitions of same explanations.

Indicated at 111 is a coater unit which is adopted in the eighth embodiment. Thus coater unit 111 is attached to a distal end of the robot arm 23, and largely constituted by an atomizer 32 and a housing member 112.

Denoted at 112 is a housing member which is adopted in the eighth embodiment. This housing member 112 is formed substantially in a cylindrical shape by the use of an electrically insulating synthetic resin material to mount the atomizer 32. A motor receptacle hole 112A is formed internally of a front side portion of the housing member 112 to accommodate an air motor 33. A shaping air ring 41 is attached to the fore end of the housing member 112. In turn, rear end of the housing member 112 is attached to a distal end of the robot arm 23.

Indicated at 113 is a cover member of a tubular shape which is fitted on in such a way as to enshroud outer surface 112B of the housing member 112. For example, substantially in the same way as the cover member 47 in the foregoing second embodiment, this cover member 113 is formed in a tubular shape by the use of a fluorine-base synthetic resin film material. The cover member 113 is extended axially along the housing member 112 as far as a position around a fore distal end portion of the robot arm 23. Thus, the cover member 113 is arranged to enshroud the outer surface 112B of the housing member 112 and outer surface of the robot arm 23 as well.

Further, the cover member 113 is fitted on and attached to annular flanges 114 which are provided at and around fore and rear end portions of the housing member 112. Except minimal areas which are in contact with the flanges 114, almost entire areas of the cover member 113 which are confronted face to face by the outer surface 112B of the housing member 112 are radially spaced from and kept out of contact with the latter. Thus, an annular gap space 115, which is an annular shape in cross section, is formed between almost the entire confronting areas of the cover member 113 and the housing member 112. On the outer peripheral side, the air motor 33 and high voltage generator 45 are almost entirely circumvented by the annular gap space 115.

Indicated at 116 is an external electrode assembly which is located on the outer peripheral side of the housing member 112, and constituted by support arms 117, electrode support members 118 and acicular electrode members 119, which will be described hereinafter.

Indicated at 117 are a plural number of support arms which are provided on a rear side portion of the housing member 112. These support arms 117 are disposed radially relative to the rotational shaft 33C of the air motor 33 and extended radially outward of the housing member 112.

Denoted at 118 are electrode support members which are provided at outer distal ends of the support arms 117 and extended forward to have the respective fore distal ends located around the rotary atomizing head 34. An acicular electrode member 119 is projected forward from the fore distal end of each electrode support member 118. The acicular electrode members 119 are connected to an external high voltage generator 45 through the electrode support members 118, support arms 117 and a robot arm 23, for applying a high voltage from the high voltage generator 45 to the respective acicular electrode members 119.

Thus, the eighth embodiment of the invention can produce substantially the same operational effects as the foregoing second embodiment. Especially in the case of the eighth embodiment, a high voltage is applied from a high voltage generator 45 to the external electrode assembly 116 which is located around the cover member 113. In this case, an ionization zone is formed around the rotary atomizing head 34 by the external electrode assembly 116, indirectly imparting an electrostatic charge to paint particles which are sprayed by the rotary atomizing head 34. Besides, by the external electrode assembly 116 to which a high voltage is applied, a high electrostatic charge is built up on outer surfaces of the cover member 113 in a stable state to prevent deposition of paint particles.

In the sixth to eighth embodiments, the cover member 47, 103 or 113 is described as being formed of a film of a fluorine-base synthetic resin material. However, alternatively the cover member may be formed of a laminated film material having a semi-conducting film sandwiched between two insulating films.

Further, in the second, sixth to eighth embodiments, the cover member 47, 103 or 113 is described as being formed of a film of a fluorine-base synthetic resin material. However, alternatively the cover member may use a polyethylene resin film formed of a polyethylene resin material if desired. Similarly, the body cover 62 or 72 which is described as being formed of a fluorine-base synthetic resin film material in the third and fourth embodiments may be formed of a polyethylene resin film material if desired.

In the fifth and sixth embodiments, the neck cover 83 or 49 of the cover member 81 or 47 is fitted on to cover the neck portion 37 of the housing member 35 alone. However, the neck cover may be arranged to cover a fore distal end portion of the robot arm 23 in the same way as in the fourth embodiment.

In the third to fifth embodiments, the neck cover 63 or 73 and cover member 81 are formed of a laminated film material having semi-conducting film 63C sandwiched between two insulating films 63A and 63B. However, the present invention is not limited to this particular arrangement. For example, of the two insulating films of the laminated film material, one insulating film on the side of the housing member (on the inner side) may be omitted, for example, if discharges from the semi-conducting film can be prevented.

Further, the conducting shaping air ring 41 in the second to eighth embodiments may be replaced by an insulating shaping air ring similar to the one employed in the first embodiment.

Further, the high voltage discharge electrode assembly 53 or 91 which is located around the shaping air ring 41 in the second to seventh embodiments may be omitted if necessary.

Figure 20:
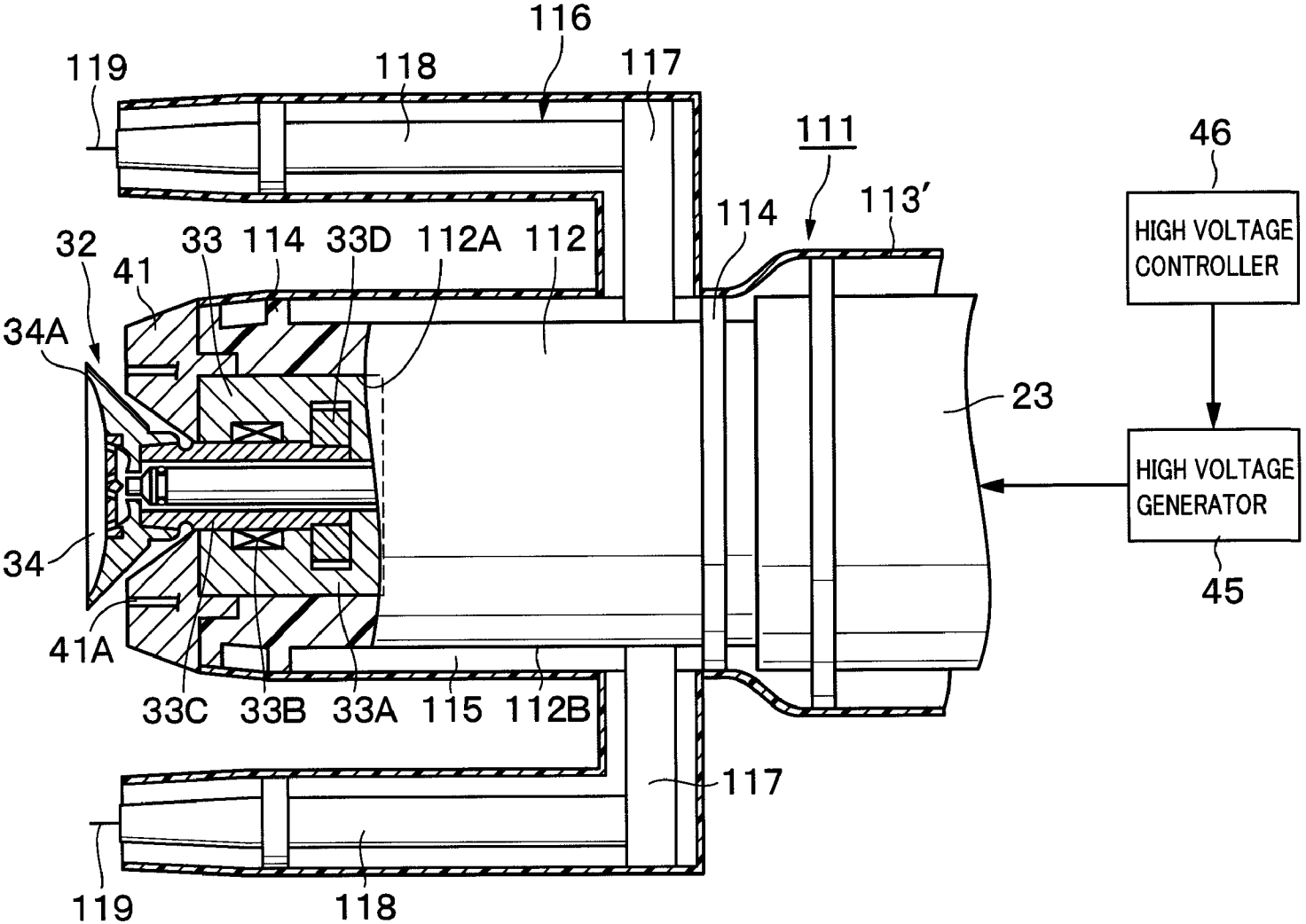
FIG. 20 is a partly cutaway front view in a position similar to FIG. 19 but showing a rotary atomizing head type coating apparatus according to a fifth modification, part of a cover member being cut away.

Furthermore, in the eighth embodiment, the cover member 113 is arranged to cover the circumference of the housing member 112 and the robot arm 23 as well. However, it is to be understood that the present invention is not limited to this particular arrangement. For example, as in the fifth modification shown in FIG. 20, there may be employed a cover member 113' which is arranged to cover the support arms 117 and electrode support members 118 of the external electrode assembly 116 in addition to the circumference of the housing member 112 and robot arm 23, to prevent deposition of paint particles on the external electrode assembly 116.

Moreover, in the second to eighth embodiments, the housing member 35, 102 or 112 of the coater unit 31, 101 or 111 is attached to the robot arm 23 of a robot device 21 which moves in various directions. However, the present invention is not limited to this particular arrangement. For example, the housing member may be mounted on an arm of a reciprocator which is put in reciprocating movements in one direction. Alternatively, the housing member may be mounted on an arm which is immovably fixed like a coater support stand.

Furthermore, in the respective foregoing embodiments, as an electrostatic coating apparatus, by way of example the present invention is applied to a rotary atomizing head type coating apparatus (rotary atomizing type electrostatic paint coating apparatus) with a rotary atomizing head 3 or 34 for atomizing and spraying paint. However, it is to be understood that the present invention is not limited to coating apparatuses of this type. The present invention is similarly applicable to electrostatic coating apparatuses other than the rotary atomizing head type, for example, to electrostatic coating apparatuses such as pneumatic or hydraulic atomizing type electrostatic coating apparatuses.

The invention claimed is:

1. An electrostatic coating apparatus comprising:

a paint atomizer adapted to spray atomized paint particles toward a work piece, a housing member formed of an insulating material and holding said paint atomizer in position, a tubular cover member formed in cylindrical shape by an insulating material and arranged to enshroud outer surfaces of said housing member, a high voltage applicator adapted to electrify sprayed paint particles from said paint atomizer with a high voltage electrostatic charge, urging charged paint particles to fly toward and deposit on said work piece, an annular gap space of an annular shape in cross section defined by two insulating materials and provided between and around almost entire radially confronting areas of said housing member and said cover member, said annular gap space surrounding almost entire radially confronting areas of said housing member and cover member, and said cover member comprising a laminated film material including a semi-conducting film sandwiched between two insulating films.

2. An electrostatic coating apparatus as defined in claim 1, wherein said housing member is formed in a columnar shape and adapted to hold said paint atomizer in a front side portion, rear end of said columnar housing member being attached to and supported on a support arm; and said cover member is extended toward said support arm beyond said housing member to cover said support arm.

3. An electrostatic coating apparatus comprising:

a paint atomizer adapted to spray atomized paint particles toward a work piece, a housing member formed of an insulating material and holding said paint atomizer in position, a tubular cover member formed in cylindrical shape by an insulating material and arranged to enshroud outer surfaces of said housing member, a high voltage applicator adapted to electrify sprayed paint particles from said paint atomizer with a high voltage electrostatic charge, urging charged paint particles to fly toward and deposit on said work piece, an annular gap space of an annular shape in cross section defined by two insulating materials and provided between and around almost entire radially confronting areas of said housing member and said cover member, said annular gap space surrounding almost entire radially confronting areas of said housing member and cover member, said housing member being composed of a main housing body adapted to hold said paint atomizer in a front side thereof, and a neck portion branched off said main housing body and attached to a support arm which supports said housing member, and said cover member being composed of a body cover enclosing said main housing body and a neck cover enclosing said neck portion of said housing member such that another annular space is disposed between the neck portion and neck cover.

4. An electrostatic coating apparatus as defined in claim 3, wherein said body cover and said neck cover are formed of a fluorine-base synthetic resin film or a polyethylene resin film.

5. An electrostatic coating apparatus as defined in claim 3, wherein said body cover and said neck cover are formed of a laminated film having a semi-conducting film sandwiched between two insulating films.

6. An electrostatic coating apparatus as defined in claim 3, wherein said body cover is formed of a fluorine-base synthetic resin film or a polyethylene resin film, and said neck cover is formed of a laminated film having a semi-conducting film sandwiched between two insulating films.

7. An electrostatic coating apparatus as defined in claim 3, wherein said neck cover is extended beyond said neck portion of said housing member as far as a position of said support arm to cover said support arm.

8. An electrostatic coating apparatus as defined in claim 4, wherein said neck cover is extended beyond said neck portion of said housing member as far as a position of said support arm to cover said support arm.

9. An electrostatic coating apparatus as defined in claim 5, wherein said neck cover is extended beyond said neck portion of said housing member as far as a position of said support arm to cover said support arm.

10. An electrostatic coating apparatus as defined in claim 6, wherein said neck cover is extended beyond said neck portion of said housing member as far as a position of said support arm to cover said support arm.

11. An electrostatic coating apparatus as defined in claim 3, further comprising a high voltage discharge electrode assembly located on the outer peripheral side of said cover member and adapted to discharge a high voltage of the same polarity as charged paint particles.

12. An electrostatic coating apparatus comprising:

a paint atomizer adapted to spray atomized paint particles toward a work piece, a housing member formed of an insulating material and holding said paint atomizer in position, a tubular cover member formed in cylindrical shape by an insulating material and arranged to enshroud outer surfaces of said housing member, a high voltage applicator adapted to electrify sprayed paint particles from said paint atomizer with a high voltage electrostatic charge, urging charged paint particles to fly toward and deposit on said work piece, an annular gap space of an annular shape in cross section defined by two insulating materials and provided between and around almost entire radially confronting areas of said housing member and said cover member, said annular gap space being formed to surround almost entire radially confronting areas of said housing member and cover member, a high voltage discharge electrode assembly located on the outer peripheral side of said cover member and adapted to discharge a high voltage of the same polarity as charged paint particles, and said high voltage discharge electrode assembly is composed of support arms extended radially outward from the side of said housing member toward the outer peripheral side of said cover member, a ring member supported on outer distal ends of said support arms and located around said paint atomizer in such a way as to circumvent said cover member, an acicular or blade-like electrode member projected from said ring member in a direction away from a work piece.

13. An electrostatic coating apparatus as defined in claim 11, wherein said high voltage discharge electrode assembly is composed of support arms extended radially outward from the side of said housing member toward the outer peripheral side of said cover member, a ring member supported on outer distal ends of said support arms and located around said paint atomizer in such a way as to circumvent said cover member, an acicular or blade-like electrode member projected from said ring member in a direction away from a work piece.

14. An electrostatic coating apparatus as defined in claim 1, wherein said high voltage applicator is adapted to apply a high voltage to said paint atomizer, directly applying a high voltage to paint being supplied to said paint atomizer.

15. An electrostatic coating apparatus as defined in claim 1, wherein said high voltage applicator is adapted to apply a high voltage to an external electrode assembly located radially outward of said cover member for indirectly imparting a high voltage electrostatic charge to sprayed paint particles from said paint atomizer.

16. An electrostatic coating apparatus as defined in claim 3, wherein said high voltage applicator is adapted to apply a high voltage to said paint atomizer, directly applying a high voltage to paint being supplied to said paint atomizer.

17. An electrostatic coating apparatus as defined in claim 3, wherein said high voltage applicator is adapted to apply a high voltage to an external electrode assembly located radially outward of said cover member for indirectly imparting a high voltage electrostatic charge to sprayed paint particles from said paint atomizer.

* * * * *